US006461780B2

(12) United States Patent
Itami et al.

(10) Patent No.: US 6,461,780 B2
(45) Date of Patent: Oct. 8, 2002

(54) ELECTROPHOTOGRAPHIC PHOTORECEPTOR, IMAGE FORMING METHOD, IMAGE FORMING APPARATUS, AND PROCESSING CARTRIDGE

(75) Inventors: Akihiko Itami; Takeo Oshiba, both of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/801,116

(22) Filed: Mar. 7, 2001

(65) Prior Publication Data

US 2001/0031412 A1 Oct. 18, 2001

(30) Foreign Application Priority Data

Mar. 13, 2000 (JP) ..... 2000-068545

(51) Int. Cl.[7] ..... G03G 5/14

(52) U.S. Cl. ..... 430/58.15; 430/66; 430/97; 430/110.3; 430/125

(58) Field of Search ..... 430/66, 67, 58.15, 430/58.7, 58.45, 97, 110.3, 125; 399/343

(56) References Cited

U.S. PATENT DOCUMENTS 5,242,776 A * 9/1993 Doi et al. ..... 430/66
6,132,913 A * 10/2000 Fuller et al. ..... 430/66
6,291,125 B1 * 9/2001 Renter ..... 430/66

FOREIGN PATENT DOCUMENTS

JP 6118681 4/1994

OTHER PUBLICATIONS

Japan The Production Methods of Toners and the Triboelectric Charing Properties, pp. 293 to 298.

* cited by examiner

*Primary Examiner*—John Goodrow
(74) *Attorney, Agent, or Firm*—Bierman, Muserlian and Lucas

(57) ABSTRACT

An electrophotographic photoreceptor is disclosed. The photoreceptor has a difference in ionization potential between the photosensitive layer and the hardenable resinous layer of not more than 0.4 eV, and a response time $T_{10}$ defined in the specification is not more than 0.25 second. An image forming method and apparatus employing the photoreceptor are also disclosed.

22 Claims, 2 Drawing Sheets

ELECTROPHOTOGRAPHIC PHOTORECEPTOR, IMAGE FORMING METHOD, IMAGE FORMING APPARATUS, AND PROCESSING CARTRIDGE

FIELD OF THE INVENTION

The present invention relates to an electrophotographic photoreceptor, and an image forming method, as well as an image forming apparatus, employing said electrophotographic photoreceptor, and a processing cartridge.

BACKGROUND OF THE INVENTION

In recent years, widely employed as electrophotographic photoreceptors, have been organic photoreceptors. Compared to other photoreceptors, organic photoreceptors exhibit advantages in that it is easy to develop materials which correspond to various types of exposure light sources ranging from visible light to infrared rays; it is possible to select materials which result in minimal environmental pollution; their production cost is lower, and the like. However, said organic photoreceptors exhibit disadvantages in that the mechanical strength is insufficient, and when producing numerous prints, the photoreceptor surface tends to be degraded or abraded.

Since electrical and mechanical external force is directly applied to the surface of electrophotographic receptors (hereinafter referred occasionally to as photoreceptors) upon employing charging means, developing means, transfer means, cleaning means, and the like, durability is required to counter such force.

Specifically required is durability to resist wear and abrasion of the photoreceptor surface due to friction, surface degradation due to active oxygen such as ozone, nitrogen oxides, and the like, which are generated during corona charging.

In order to overcome said drawbacks, techniques have been investigated in which a protective layer, exhibiting enhanced strength, is provided on the photoreceptor surface, and the like. For example, Japanese Patent Publication Open to Public Inspection No. 6-118681 discloses that silicone resins are employed as the protective layer of the photoreceptor. However, the transportability of generated carriers results in problems. As a result, particularly at the low humidity environment, which results in an increase in resistance, problems result in response properties. In the field of digital copiers, high image quality has been increasingly demanded, followed by the investigation of the image formation resulting in high resolution. However, the surface protective layer, which exhibits such insufficient response properties, results in diffusion of carriers and it, is impossible to obtain excellent electrostatic latent images.

In order to faithfully reproduce image information as electrostatic latent images, it is required that the electric potential contrast of an exposed area to an unexposed area is sufficiently limited. In order to realize said contrast, it is important to retard the diffusion of carriers from their generated sites to the charge surface. Nihon Gazo Gakkai Shi (Journal of Japan Image Society), Volume 39, No. 3, page 294–295 describes said diffusion as follows: when the ratio of $D/\mu$ increases, it is impossible to neglect the effects of the diffusion to an electrostatic latent image, wherein D is the diffusion constant of the charge transport layer, and $\mu$ is the drift mobility, while the thickness of the charge transport layer increases, the degradation of latent images increases. However, organic electrophotographic photoreceptors, which are commonly employed, result in a large decrease in the layer thickness due to the sliding of cleaning blades and the like. Accordingly, it has not been preferred to design the thickness of the photosensitive layers, such as a charge transport layer and the like, to be not more than 20 $\mu$m because the durability of the resulting photoreceptor is further degraded.

From the view of the foregoing, investigations have been conducted on electrophotographic receptors which exhibit sufficient strength against the sliding of cleaning blades and the like, and provide sufficient electric potential contrast of the exposed area to an unexposed area in the low humidity environment, a high quality image forming method, and an image forming apparatus employing said electrophotographic photoreceptor, and the like.

SUMMARY OF THE INVENTION

It is an object of the present invention to overcome the aforementioned drawbacks, and to provide a photoreceptor which possesses high surface hardness, high wear resistance, and provides sufficient and consistent electrophotographic properties during repeated use, such as electric potential contrast of an exposed area to an unexposed area at a severe ambience such as high temperature and high humidity as well as low temperature and low humidity, and further, provides an image forming method as well as an image forming apparatus employing said photoreceptor, and a processing cartridge employed in said image forming apparatus.

The inventors of the present invention have conducted investigations to solve the problems described above. As a result, it was discovered that in a photoreceptor in which a hardenable resinous layer having high surface hardness, a decrease in the difference of ionization potential between said hardenable resinous layer and the underlying photosensitive layer, such as, for example, a charge transport layer, effectively retarded the diffusion of carriers of said photoreceptor. Namely, it was discovered that when the difference in ionization potential between said hardenable resinous layer and said transport layer was kept at not more than 0.4 eV and a response time of the total photoreceptor is kept at not more than 0.25 second, electrostatic latent images can be consistently resulting in excellent images.

The present invention and the embodiments thereof will now be described.

1. An electrophotographic photoreceptor comprises an electrically conductive support having thereon a photosensitive layer and a hardenable resinous layer, wherein a difference in ionization potential between said photosensitive layer and said hardenable resinous layer is not more than 0.4 eV, and a response time $T_{10}$ defined below is not more than 0.25 second.

<Response Time $T_{10}$>

When a photoreceptor charged at |600 V|±20 V is subjected to a sufficient amount of light irradiation so that |200 V| or less results due to light decay, said response time $T_{10}$ refers to the elapsed time during which the average of 10 electrical potentials between surface electric potential data adjacent to each other, which are measured at an interval of 10 milliseconds after light irradiation, reaches 10 V or less.

2. In the electrophotographic photoreceptor of described above, the photosensitive layer preferably comprises a charge generating layer and a charge transport layer, and a difference in ionization potential between said charge transport layer and said hardenable resinous layer is not more than 0.4 eV, and a response time $T_{10}$ is not more than 0.25 second.

3. In the electrophotographic photoreceptor of described in 1. or 2. above, said hardenable resinous layer is preferably a siloxane based resinous layer which is obtained by allowing an organic silicon compound having a hydroxyl group or a hydrolyzable group to react with a compound represented by General Formula (1).

$$B—(R_1—ZH)_m \qquad \text{General Formula (1)}$$

wherein B represents a univalent or multivalent group comprising structural units having charge transportability, $R_1$ represents a single bond or divalent alkylene group, Z represents an oxygen atom, a sulfur atom or NH, and m represents an integer of 1 to 4.

4. In the electrophotographic photoreceptor described in 3. above, Z in General Formula (1) is preferably an oxygen atom.

5. In the electrophotographic photoreceptor described in any one of in 1. through 4. above, said hardenable resinous layer is preferably a cross-linking structure containing siloxane based resinous layer exhibiting charge transportability.

6. In the electrophotographic photoreceptor described in 5. above, said siloxane based resinous layer preferably comprises the partial structure represented by the aforementioned General Formula (2).

$$B—(R_1—ZH)_m \qquad \text{General Formula (2)}$$

wherein B represents a univalent or multivalent group comprising structural units having charge transportability, $R_1$ represents a single bond or divalent alkylene group, Z represents an oxygen atom, a sulfur atom or NH, and m represents an integer of 1 to 4.

7. In the electrophotographic photoreceptor described in any one of 1. through 6. above, said hardenable resinous layer preferably comprises colloidal silica or metal oxide particles.

8. The electrophotographic photoreceptor described in any one of 1. through 7. above, said hardenable resinous layer preferably comprises an antioxidant.

9. In the electrophotographic photoreceptor described in any one of 1. through 8. above, said hardenable resinous layer is preferably the protective layer of said electrophotographic photoreceptor.

10. In the electrophotographic photoreceptor described in 1. above, the total layer thickness of said photosensitive layer and said hardenable resinous layer is preferably not more than 15 $\mu$m, and said response time $T_{10}$ is preferably not more than 0.1 second.

11. An image forming method which comprises at least each process of charging, image exposure, development, and blade cleaning, and forms a latent image by employing an electrophotographic photoreceptor described in any one of 1. through 10. above as well as by employing a light beam having a spot area of not more than 2,000 $\mu m^2$ during said image exposure process.

12. The image forming method described in 11. above wherein the spot area of said light beam is preferably not more than 1,000 $\mu m^2$.

13. In the image forming method described in 11. above, the electrophotographic photoreceptor described in any one of 1. through 10. above is employed and the average particle diameter of a toner employed in said development process is preferably between 3 and 8 $\mu$m.

14. In the image forming method described in 13. above wherein the ratio of toner having a shape coefficient of 1.0 to 1.6, is preferably at least 65 percent in terms of the number of particles.

15. In the image forming method described in 13. or 14. above, a latent image is formed preferably employing a light beam having a spot area of not more than 2,000 $\mu m^2$.

16. An image forming method which comprises at least each process of charging, image exposure, development, and blade cleaning, and forms an image by employing an electrophotographic photoreceptor described in any one of 1. through 10. above, so that time from said image exposure process to said development process is within 100 milliseconds.

17. An image forming apparatus which comprises at least each device of charging, image exposure, development, and blade cleaning, and forms a latent image by employing an electrophotographic photoreceptor described in any one of 1. through 10. above, as well as by employing a light beam having a spot area of 2,000 $\mu m^2$ in said image exposure device.

18. An image forming apparatus which comprises at least each device of charging, image exposure, development, and blade cleaning, and forms a latent image by employing an electrophotographic photoreceptor described in any one of 1. through 10. above, as well as by employing a toner having an average particle diameter of 3 to 8 $\mu$m in said development device.

19. In an image forming apparatus described in 18. above wherein the ratio of a toner having a shape coefficient in the range of 1.0 to 1.6, is preferably at least 65 percent in terms of the number of particles of the toner.

20. In an image forming apparatus described in 18. or 19. above, a latent image is formed preferably employing a light beam having a spot area of not more than 2,000 $\mu m^2$ during the image exposure process.

21. An image forming apparatus which comprises at least each device of charging, image exposure, development, and blade cleaning, and forms an image by employing an electrophotographic photoreceptor described in any one of 1. through 10. above so that time from process by said image exposure device to process by said development device is within 100 milliseconds.

22. A processing cartridge which is employed in an image forming apparatus comprising at least device of charging, image exposure, development, and cleaning, and has an integral combination of the photoreceptor described in any one of 1 through 10. above with any one of a charging means, exposure means, a development means, and a cleaning means, and is designed to be freely mounted on and dismounted from said image forming apparatus.

DETAILED DESCRIPTION OF THE INVENTION

Figure 1:
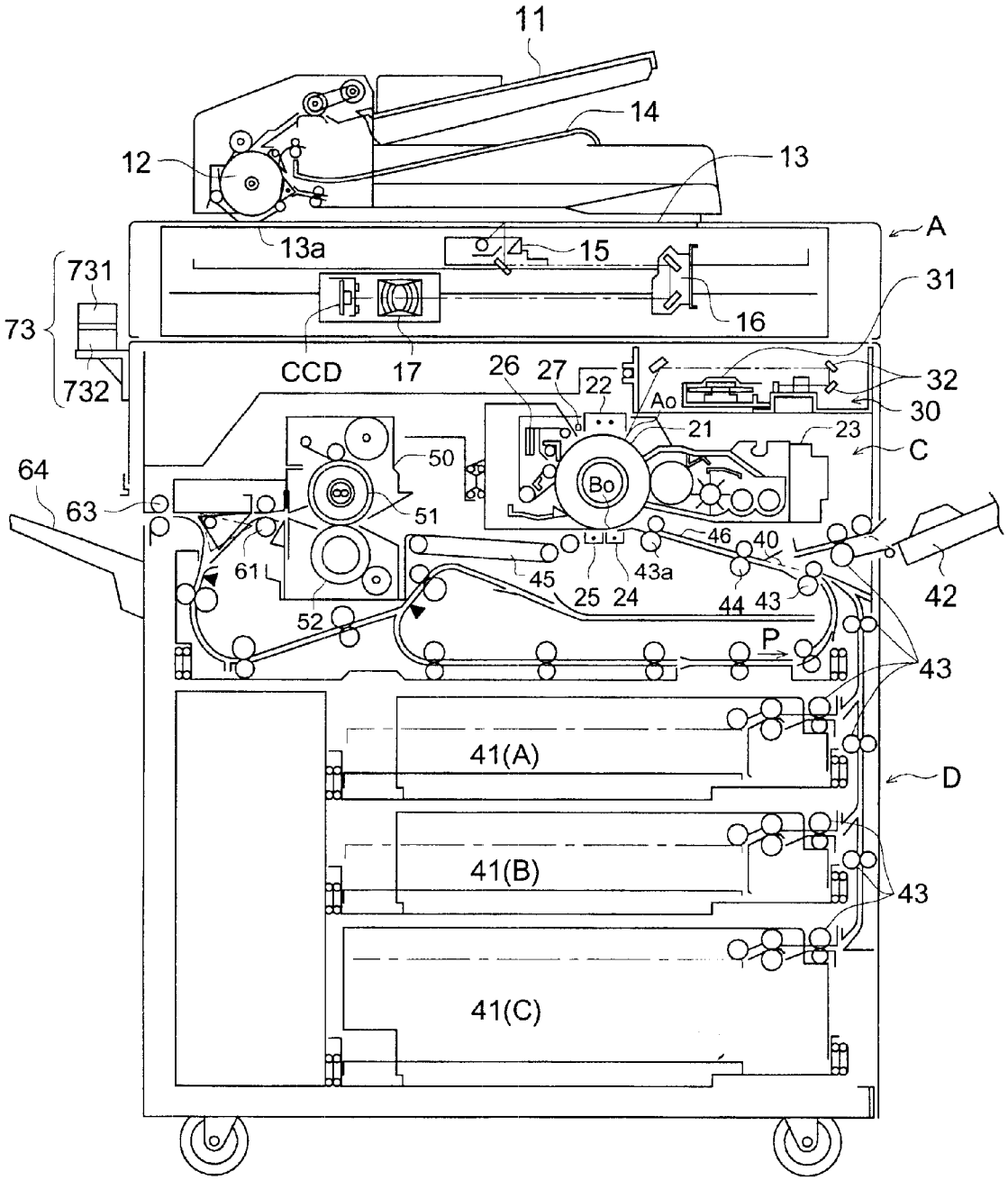
FIG. 1 is a schematic view showing the entire constitution of the image forming apparatus of the present invention.

The response time of the present invention will now be described.

The response time $T_{10}$ of the present invention refers to the elapsed time during which the average of 10 electric potential differences between electric surface potential data adjacent with each other, which are measured at an interval of 10 milliseconds after light irradiation, reaches 10 V or less, when a photoreceptor charged at |600 V|±20 V is subjected to a sufficient amount of light irradiation so that |200 V| or less can result due to light decay.

Said elapsed time, during which the average of 10 electric potential differences between surface electric potential data adjacent to each other, means that said electric potential difference data between data adjacent to each other are subjected to shifting datum by datum in sequential time sequence so as to form 10 data blocks and the average of 10 electric potential differences in said data blocks firstly reaches 10 V or less.

The ionization potential of the present invention will now be described.

The ionization potential generally means a numerical value of energy in electron volt units, which is required to infinitely remove one electron from an atom or a molecule in the ground state. However, the ionization potential, as described in the present invention, refers to the representative value of the highest occupied level of positive hole transport materials as the standard of the energy level in the case of positive hole transport.

The ionization potential of hardenable resinous layers can be obtained in such a manner that a cast hardenable resinous layer is subjected to bombardment of accelerated electrons or photons and the lowest energy which generates ions due to ionization is measured. In the present invention, the ionization potential was measured employing a surface test apparatus "AC-1" (manufactured by Riken Keiki Co.).

In order to adjust the ionization potential difference (ΔIP) between the hardenable resinous layer of the present invention and the photosensitive layer to not more than 0.4 eV, it is required that the entire hardenable resinous layer is allowed to result in uniform mobility properties of charge carriers and further, the ionization potential of the adjacent photosensitive layer approaches that of said hardenable resinous layer. Still further, described are a method to provide charge transportability to said hardenable resinous layer, a method to approach the ionization potential of a charge transport layer to that of said hardenable resinous layer, and further a method to approach the ionization potential of said hardenable resinous layer to that of said charge transport layer.

The hardenable resinous layer, as described in the present invention, refers to a resinous layer of high hardness, in which, three-dimensional cross-linking structure s are formed in such a manner that during the layer forming process, components, such as monomers, oligomers, polymers, or the like, which constitute said resin, mutually enhance chemical reaction in the presence of energy such as heat, light, and the like.

Listed as resinous materials for such hardenable resinous layer are, for example, melamine resins, epoxy resins, phenol resins, urethane resins, and the like. In the present invention, electrophotographic photoreceptors were prepared employing the siloxane based resins described below. The electrophotographic photoreceptors having said siloxane based resinous layer will now be described.

Hardenable Resinous Layer of the Present Invention (Siloxane Based Resinous Layer Comprising Structural Units Having Charge Transportability The electrophotographic photoreceptor of the present invention employs a siloxane based resinous layer comprising structural units having charge transportability as the protective layer. It is possible to obtain said siloxane based resinous layer by coating and subsequently drying a composition consisting of hardenable organic silicon compounds describe below and charge transferable compounds which react with said organic silicon compounds.

Said siloxane based resinous layer is formed by applying, onto a support, a coating composition prepared by employing organic silicon compounds represented by General Formula (3), described below, as the raw materials and subsequently drying said coated layer. These raw materials undergo hydrolysis in a hydrophilic solvent and subsequently result in a condensation reaction. Thus, they form condensation products (oligomers) of organic silicon compounds in a solvent. By applying these coating compositions onto a support and subsequently drying the resultant coated layer, it is possible to form a resinous layer comprising siloxane based resins forming a three-dimensional net structure.

$$(R)_n—Si—(X)_{4-n} \qquad \text{General Formula (3)}$$

wherein Si is a silicon atom, R represents an organic group in which a carbon atom directly bonds to a silicon atom, X represents a hydroxyl group or a hydrolyzable group, and n represent an integer of 0 to 3.

In organic silicon compounds represented by General Formula (3), listed as organic groups represented by R, in which the carbon atom directly bonds to the silicon atom, are an alkyl group such as methyl, ethyl, propyl, butyl, and the like; an aryl group such as phenyl, tolyl, naphthyl, biphenyl, and the like; an epoxy containing group such as γ-glycidoxypropyl, β-(3,4-epoxycyclohexyl)ethyl, and the like; an acryloyl or methacryloyl containing group such as γ-acryloxypropyl, and γ-methacryloxypropyl; a hydroxy containing group such as γ-hydroxypropyl, 2,3-dihydroxypropyloxypropyl, and the like; a vinyl containing group such as vinyl, propenyl, and the like; a mercapto containing group such as γ-mercaptopropyl, and the like; an amino containing group such as γ-aminopropyl, N-β (aminoethyl)-γ-aminopropyl and the like; a halogen containing group such as γ-chloropropyl, 1,1,1-trifluoropropyl, nonafluorohexyl, perfluorooctylethyl and the like; and others such as a nitro- or cyano-substituted alkyl group. Specifically preferred are alkyl groups such as methyl, ethyl, propyl, butyl, and the like. Further, listed as hydrolyzable groups represented by X are an alkoxy group such as methoxy, ethoxy, and the like, a halogen atom, and an acyloxy group. Specifically preferred are alkoxy groups having not more than 6 carbon atoms.

In said hardenable resinous layer, the compounds represented by the aforementioned General Formula (1) further undergo condensation reaction with the aforementioned organic silicon compounds, condensation products, or the like, and thus, the resulting compounds are included in said resinous layer. By modifying said resinous layer into a siloxane based resinous layer comprising structural units having charge transportability, said siloxane based resinous layer is provided with charge transportability, and thus, the ionization potential is effectively decreased.

$$B—(R_1—ZH)_m \qquad \text{General Formula (1)}$$

wherein B represents a univalent or multivalent group comprising structural units having charge transportability, namely, the chemical structure which eliminates the group of $(R_1—ZH)_m$ from the formula (1) has charge transportability, or a compound BH which is prepared by that the group of $(R_1—ZH)_m$ from the formula (1) is substituted by a hydrogen atom the compound has charge transportability. In one embodiment, $R_1$ represents a single bond or divalent alkylene group, Z represents an oxygen atom, a sulfur atom or NH, and m represents an integer of 1 to 4.

In other definition, the charge transportable structural unit is a chemical structural unit or a residue of charge transportable compound by which an electric current caused by charge transportation can be detected by a known method for detecting the charge transportation ability such as Time-Of-Flight method.

Said siloxane based resinous layer, comprising structural units having charge transportability, may be structured in such a manner that colloidal silica and metal oxide particles are dispersed into said siloxane based resinous layer. Namely, the hardenable resinous layer of the present invention is a composite resinous layer comprised of said siloxane based resins, and colloidal silica and metal oxide particles. Said metal oxide particles will now be described.

<Metal Oxide Particles>

The metal oxide particles, as described in the present invention, are those having an average particle diameter of 1 nm to 1 $\mu$m, and most preferably of 10 nm to 200 nm. They are commonly synthesized employing a liquid phase method.

Listed as examples of metal atoms of said metal oxide particles are Si, Ti, Al, Cr, Zr, Sn, Fe, Mg, Mn, Ni, Cu, and the like. These metal oxide particles are available in the form of colloidal particles.

Said metal oxide colloidal particles can be synthesized from metal oxides such as metal alkoxides, metal aryloxides, or the like, represented by the following General Formula:

$$M(OR)_4$$

wherein M represents a metal atom, and R represents an alkyl group having from 1 to 20 carbon storms, an aryl group, a phenyl group, and a benzyl group.

Said colloidal particles can be obtained via a sol-gel process. In said sol-gel process, first, a sol is obtained by suspending metal oxides in alcohol/aqueous medium in the presence of catalysts. The metal oxide in said liquid medium undergoes hydrolysis to form a gel through aggregation, and aggregated metal oxide result in colloidal particles.

The surface of said colloidal silica and metal oxide particles preferably has a group which is reactive with said organic silicon compounds. Listed as said groups having said reactivity are, for example, a hydroxyl group, an amino group, and the like. By employing such colloidal silica or metal oxide particles having a reactive group, the siloxane based resinous layer of the present invention is modified to be a layer in which siloxane based resins undergo chemical bond with said surface. As a result, the strength as well as the elasticity of said resinous layer is enhanced. Thus when said resinous layer is utilized as the protective layer of a photoreceptor, the resulting photoreceptor exhibits sufficient wear resistance for the sliding of cleaning blades and the like, and also provides excellent electrophotographic properties.

The composition ratio of the total weight (H) of the condensation product formed from said organic silicon compound, having a hydroxyl group or hydrolyzable group, and an organic silicon compound, having a hydroxyl group or a hydrolyzable group, to the composition of compound (I) represented by the aforementioned General Formula (2) is preferably between 100:3 and 50:100 in terms of the weight ratio, and is more preferably between 100:10 and 50:100.

In the present invention, further, colloidal silica or other metal oxides may be added. When colloidal silica or other metal oxides (J) are added, 1 to 30 weight parts of (J) is preferably employed with respect to 100 parts of said total weight (H) plus the weight of compound (I) component.

When a component, having said total weight (H), is employed within said range, the surface layer of the photoreceptor of the present invention exhibits high hardness as well as sufficient elasticity. The metal oxide in the component (J) is employed within said range, the similar characteristics are observed. When the (I) component of the compound is employed within said range, ionazation potential between the siloxane resin and the photosensitive layer is reduced, and the photoreceptor of the present invention exhibits good electrophotographic property such as sensitivity and residual potential characteristics as well as sufficient elasticity.

When said siloxane based resinous layer is formed, in order to enhance condensation reaction, condensation catalysts are preferably employed. The condensation catalysts employed herein may be those which either catalytically act on condensation reaction or move the reaction equilibrium of the condensation reaction in the reaction proceeding direction.

Employed as specific condensation catalysts may be those known in the art such as acids, metal oxides, metal salts, alkyl aminosilane compounds, and the like, which have conventionally been employed in silicone hard coat materials. For example, listed may be alkali metal salts of organic carboxylic acids, nitrous acid, sulfurous acid, aluminic acid, carbonic acid, and thiocyanic acid; organic amine salts (tetramethylammonium hydroxide, tetramethylammonium acetate), tin organic acid salts (stannous octoate, dibutyl tin acetate, dibutyl tin dilaurate, dibutyl tin mercaptide, dibutyl tin thiocarboxylate, dibutyl tin maliate, and the like; and the like.

(B-1)

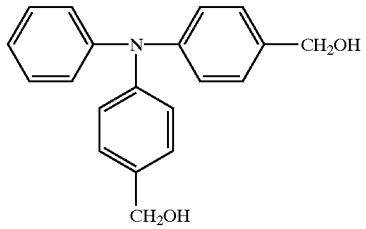

(B-2)

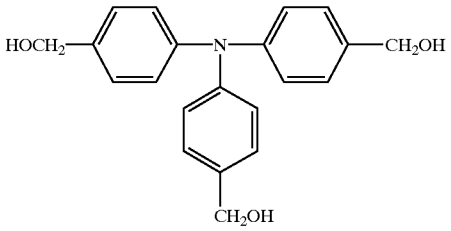

(B-3)

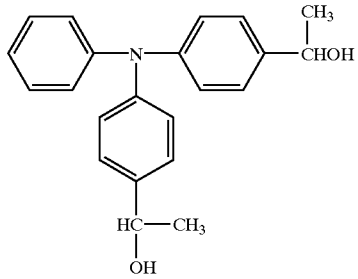

(B-4)

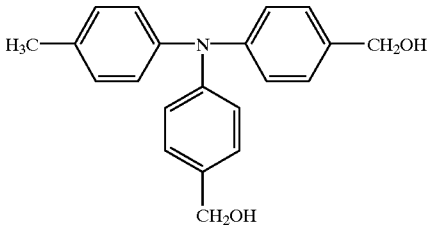

-continued
(B-5)
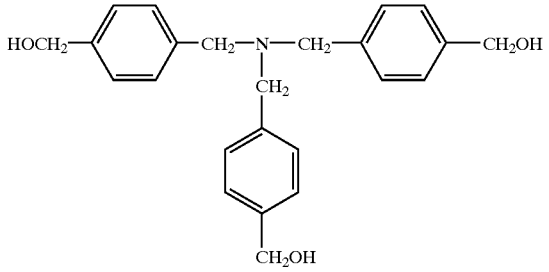
(B-6)
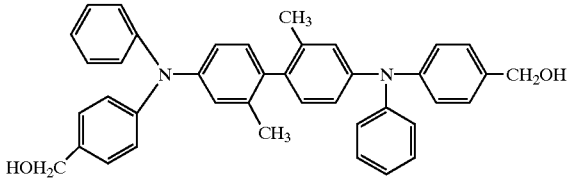
(B-7)
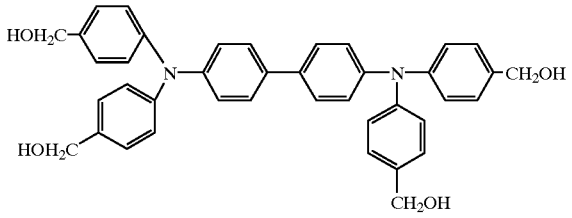
(B-8)
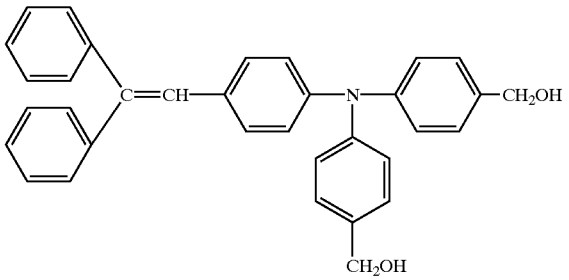
(B-9)
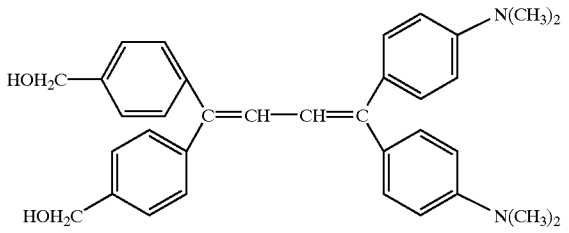
(B-10)
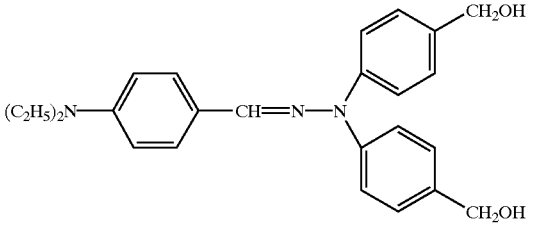
-continued
(B-11)
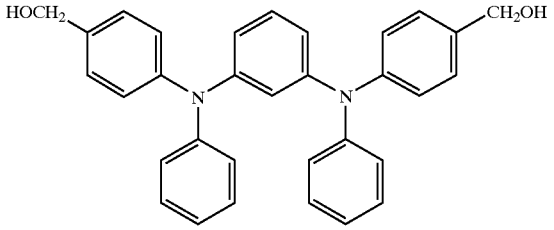
(B-12)
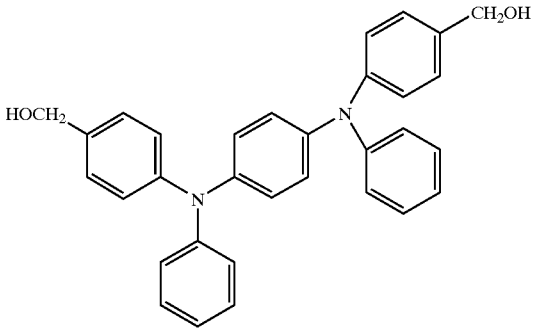
(B-13)
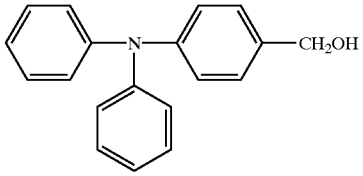
(B-14)
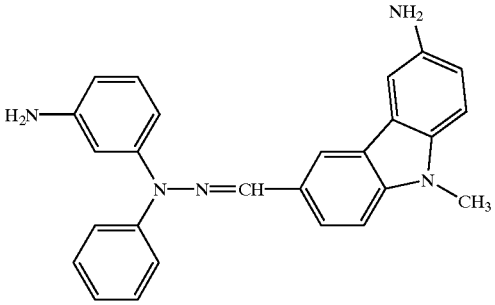
(B-15)
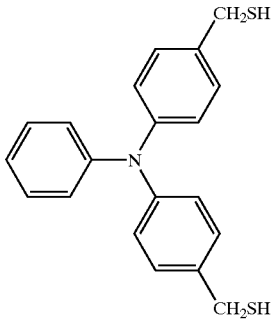
Further, by employing the compounds represented by General Formula (4) described below, it is possible to also form a siloxane based resinous layer comprising structural units having charge transportability.
$$B\text{—}(\text{—}R_1\text{—}Si(R_{11})_{3-a}R_{12})_a)_n \qquad \text{General Formula (4)}$$

wherein B represents a group comprising structural unit having charge transportability, $R_{11}$ represents a hydrogen atom, a substituted or unsubstituted alkyl group, and an aryl group, $R_{12}$ represents a hydrolyzable group or a hydroxyl group, $R_1$ represents a substituted or unsubstituted alkylene group, "a" represents an integer of 1 to 3, and "n" represents any integer.

Representative examples represented by said General Formula (4) are illustrated below.

Si-1

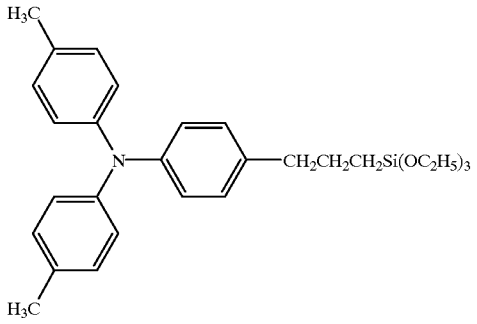

Si-2

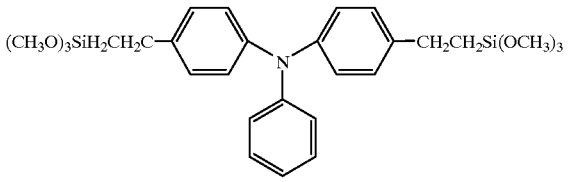

Si-3

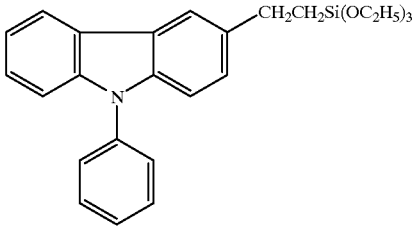

The most preferred compounds represented by said General Formula (1) are those in which Z represents a hydroxyl group (—OH) and "m" is at least 2. Compounds, in which Z represents a hydroxyl group (—OH) and "m" represents at least 2, are allowed to react with organic silicon compounds to enter into the net structure of siloxane based resins. As a result, the ionization potential of said hardenable resinous layer decreases, and it is possible to provide said hardenable resinous layer with sufficient charge transportability.

The resinous structure, as described previously, is one in which the charge transferable compounds represented by the aforementioned General Formula (1) are included into said siloxane based resin through chemical reaction, in such a manner that the partial structure represented by the aforementioned General Formula (2) is included into the structure of said siloxane based resin. Namely, via the carbon atom or silicon atom constituting said charge transportable compounds, bonding to a bonding atom or a bonding group represented by Y in the aforementioned General Formula (2) proceeds and inclusion into the siloxane base resin is carried out via Y.

Y in the aforementioned General Formula (2) is preferably a bivalent or higher atom or group removing the adjacent bonding atom (a silicon atom Si and a carbon atom C which constitute a part of said structural units having charge transportability).

However, when Y is a trivalent or higher atom, the bonding bond of Y other than Si and C may bond to any bondable atom which constitutes said siloxane based resin or has a structure (a group) bonding to other atoms or molecular group.

Further, in the aforementioned General Formula, particularly preferred atoms represented by Y include an oxygen atom (O), sulfur atom (S), and a nitrogen atom (N).

Herein, when Y represents a nitrogen atom (N), said bonding group is expressed by —NR— (wherein R represents a hydrogen atom or a univalent organic group).

Structural unit X, having charge portability, is shown as a univalent group in said General Formula. However, when a charge transportable compound, which is allowed to react with siloxane based resins, possesses at least two reactive functional groups, said X may form bonds as a divalent or higher crosslinking group in the siloxane based resin, or simply as a pendant group.

The ionization potential of said siloxane based resinous layer varies depending on the chemical structure of said structural unit X having charge portability which is contained in said siloxane based resin as a partial structure, as well as the employed amount. As a result, the difference in the ionization potential between the said siloxane resinous layer and the adjacent photosensitive layer may exceed the limit specified by the present invention. In the resulting photoreceptor, the decrease in sensitivity, an increase in residual electric potential, and degradation of time response of electrophotographic properties result.

In order to effectively decrease the ionization potential of the aforementioned siloxane based resinous layer and to approach its ionization potential to that of the photosensitive layer, said siloxane based resinous layer is produced employing compounds represented by General Formula (1) in which "Z" represents a hydroxyl group (—OH) and "m" represents 2 or more. Said compounds represented by General Formula (1), in which "Z" represents a hydroxyl group (—OH) and "m" represents 2 or more, are allowed to react with the aforementioned organic silicon compounds so that the resulting compounds enter into the net structure of said siloxane based resins. As a result, the ionization potential of said hardenable resinous layer is decreased so as to approach that of the photosensitive layer adjacent to said hardenable resinous layer, followed by a decrease in the electric field barrier at the contact interface between said photosensitive layer and said siloxane based resinous layer. As a result, as a whole, the photoreceptor is subjected to improvement of sensitivity, residual potential, and time response properties as one of electrophotographic characteristics. On the other hand, even in the case of employing compounds represented by General Formula (1) in which Z represents a hydroxyl group, the ionization potential of said siloxane based lesions layer markedly varies depending on differences in the chemical structure of said charge transport structure X. Thus, in order to approach the ionization potential of said siloxane based resinous layer to that of the photosensitive layer adjacent to it, it is required to sufficiently control each of components constituting said siloxane based resinous layer as well as the ratio of the components.

On the other hand, as a method to decrease the difference in ionization potential between the photosensitive layer of the present invention and the hardenable resinous layer, it also is effective to approach the ionization potential said photosensitive layer to that of said hardenable resinous layer. The photosensitive layer configuration of the resent invention will now be described.

The layer configuration of the electrophotographic photoreceptor of the present invention is not particularly limited, and it is preferably constituted in such a manner that the hardenable resinous layer of the present invention is applied onto a photosensitive layer(s) comprised of a charge generating layer and a charge transport layer, or a charge generating and transport layer (which comprises a charge generating function as well as a charge transport function in a single layer), and the like.

Photosensitive Layer

The photosensitive layer configuration of the photoreceptor of the present invention may be one comprising a single layer structure on said interlayer, which exhibits a charge generating function as well as a charge transport function. However, a more preferable configuration is that the photosensitive layer is comprised of a charge generating layer (CGL) and a charge transport layer (CTL). By employing said configuration of distinct functions separated, it is possible to control an increase in residual potential, under repeated use at a low level, and to readily control the other electrophotographic properties to desired values. A negatively chargeable photoreceptor is preferably composed in such a manner that applied onto the interlayer is the charge generating layer (CGL), onto which the charge transport layer is applied. On the other hand, a positively chargeable photoreceptor is composed so that the order of the layers employed in the negatively chargeable photoreceptor is reversed. The most preferable photosensitive layer configuration is the negatively chargeable photoreceptor configuration having said distinct functional structure.

The photosensitive layer configuration of the negatively chargeable photoreceptor having a distinct function separated will now be described.

Charge Generating Layer The charge generating layer comprises charge generating materials (CGM). As to other materials, if desired, binder resins and other additives may be incorporated.

Employed as charge generating materials may be those commonly known in the art. For example, employed may be phthalocyanine pigments, azo pigments, perylene pigments, azulenium pigments, and the like. of these, CGMs, which are capable of minimizing an increase in residual potential under repeated use, are those which comprise a three-dimensional electrical potential structure capable of forming stable agglomerated structure among a plurality of molecules. Specifically listed are CGMs of phthalocyanine pigments and perylene pigments having a specific crystalline structure. For instance, titanyl phthalocyanine having a maximum peak at 27.2° of Bragg angle 2θ with respect to a Cu—Kα line, benzimidazole perylene having a maximum peak at 12.4° of said Bragg 2θ, and the like, result in minimum degradation after repeated use, and can minimize the increase in residual potential.

When in the charge generating layer, binders are employed as the dispersion media of CGM, employed as binders may be any of the resins known in the art. Listed as the most preferable resins are formal resins, butyral resins, silicone resins, silicone modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transport Layer

The charge transport layer comprises charge transport materials (CTM) as well as binders which disperse CTM and form a film. As other materials, if desired, incorporated may be additives such as antioxidants and the like.

Employed as charge transfer materials (CTM) may be any of those known in the art. For example, it is possible to employ triphenylamine derivatives, hydrazone compounds, styryl compounds, benzidine compounds, butadiene compounds, and the like. These charge transport materials are commonly dissolved in appropriate binder resins and are then subjected to film formation.

Th e ionization potential of said charge transport layer greatly depends on the amount, as well as the structure, of charge transport compounds which are the major components of said charge transport layer. As the useful charge transport materials of the present invention, it is important to choose from the aforementioned various charge transport materials which have lower ionization potential than that of the aforementioned hardenable resinous layer so as to have the difference of 0.4 eV from that. The charge transport materials, which are useful for the present invention, preferably have an ionization potential of 5.0 to 5.7 eV, and more preferably 5.2 to 5.5 eV. Listed as such charge transport materials are those shown below.

(T-1)

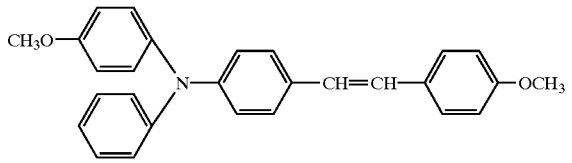

(T-2)

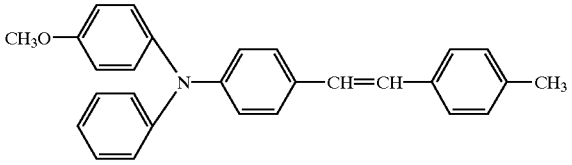

(T-3)

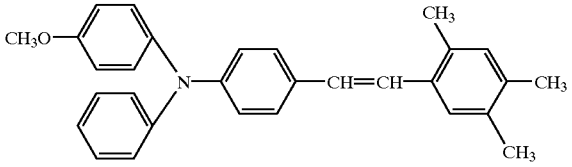

(T-4)

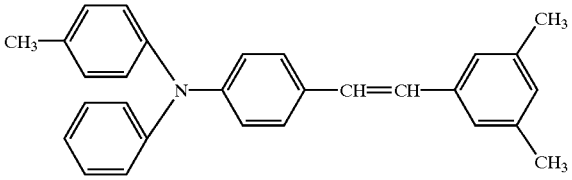

(T-5)

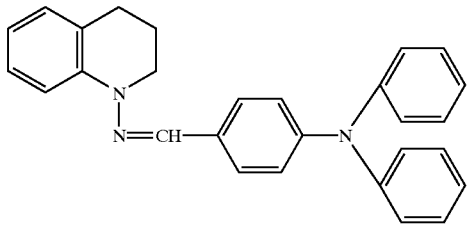

(T-6)

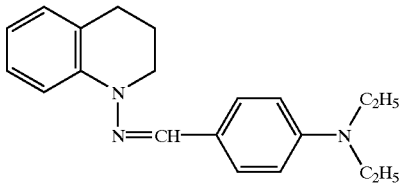

-continued
(T-7)
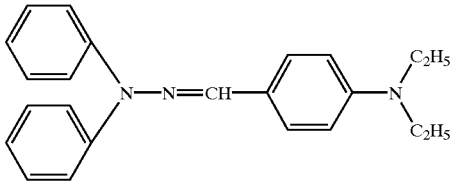
(T-8)
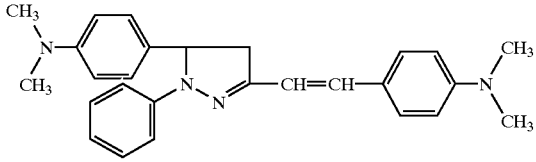
(T-9)
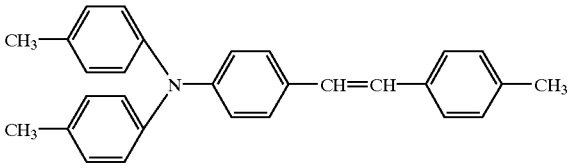
(T-10)
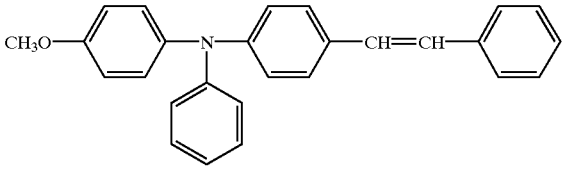
(T-11)
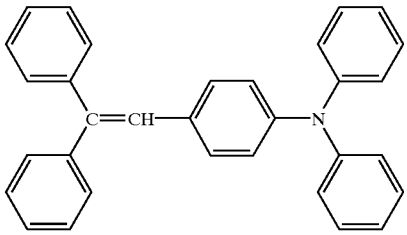
(T-12)
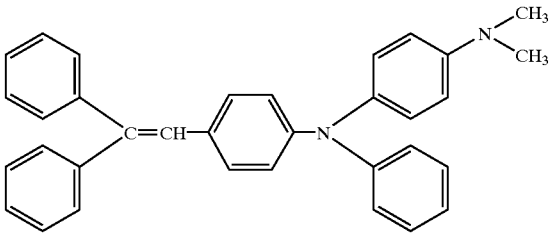
(T-13)
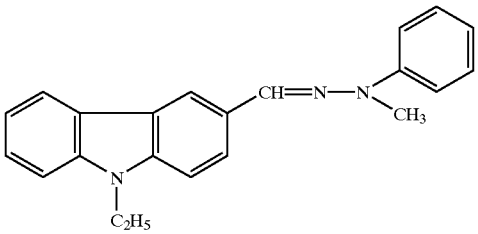
-continued
(T-14)
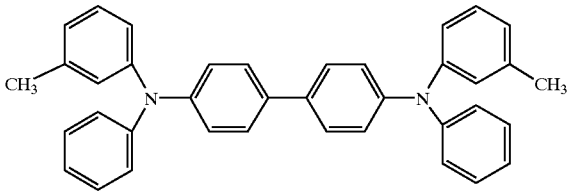
(T-15)
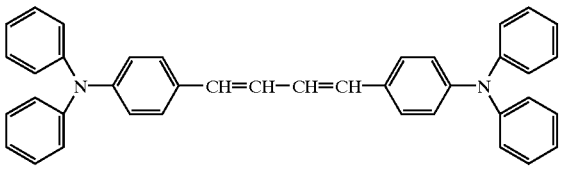
(T-16)
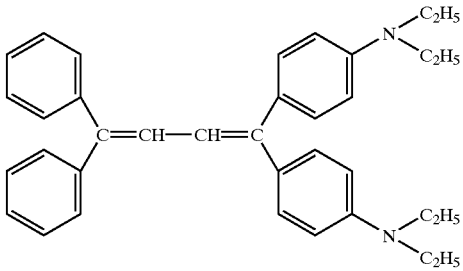
(T-17)
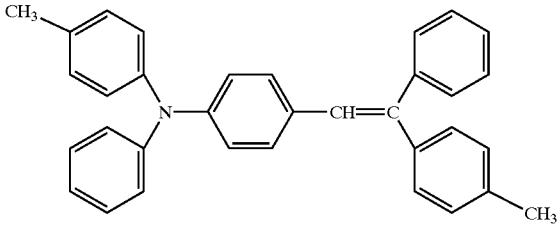
(T-18)
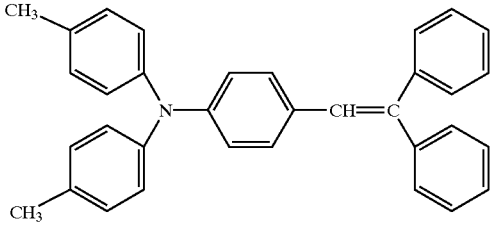
(T-19)
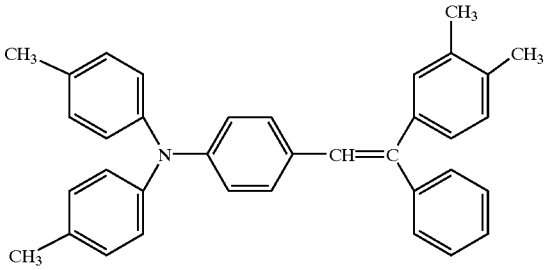

-continued (T-20)

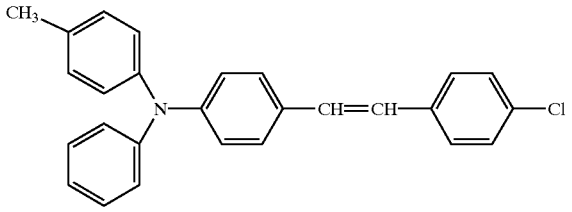

(T-21)

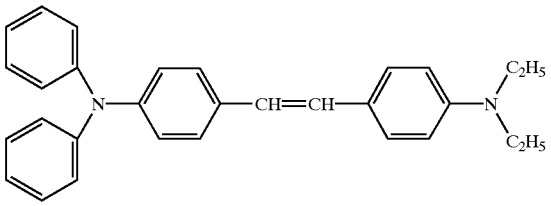

(T-22)

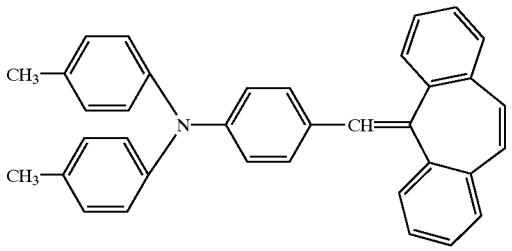

(T-23)

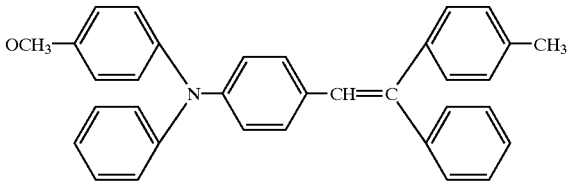

(T-24)

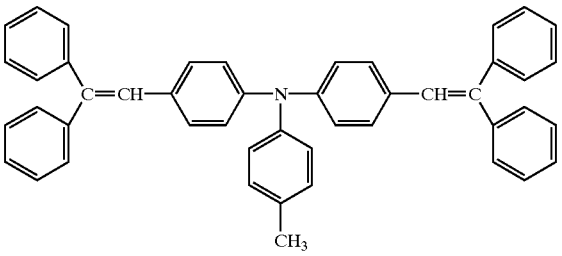

(T-25)

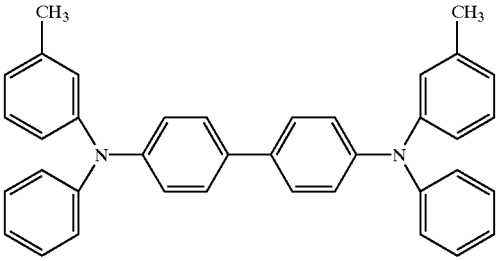

-continued (T-26)

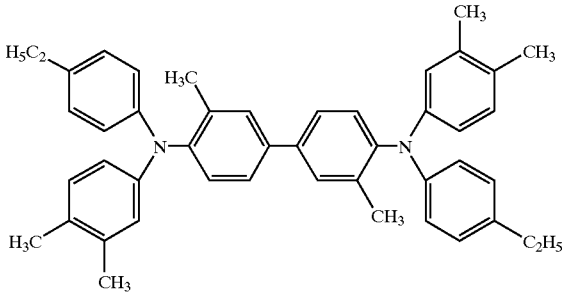

(T-27)

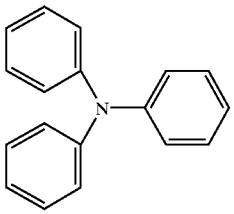

(T-28)

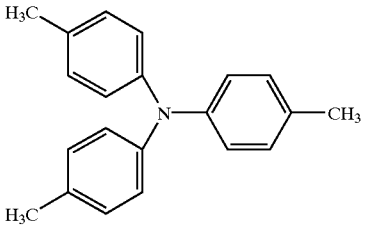

(T-29)

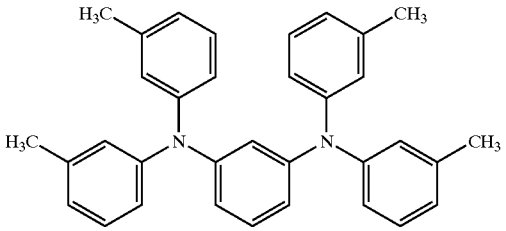

(T-30)

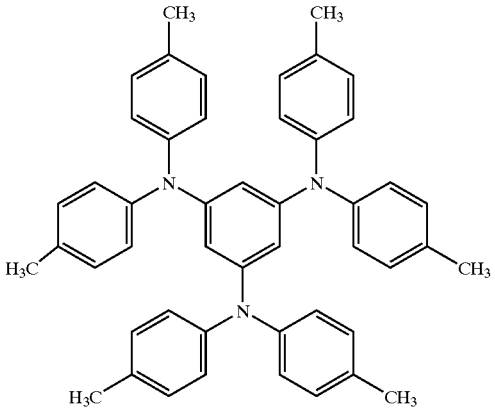

The ionization potential of CGM and CTM is measured employing a Surface Analyzer AC-1 (manufactured by Riken Keiki Co.).

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors such as poly-N-vinylcarbazole.

Polycarbonate resins are most preferable as CTL binders. Polycarbonate resins are most preferred because of improved dispersibility of CTM as well as electrophotographic properties. In the case of a photoreceptor in which the charge transport layer is employed as the surface layer, polycarbonates, which exhibit high mechanical wear resistance, are preferred and polycarbonates having an average molecular weight of at least 40,000 are preferable. The ratio of binder resins to charge transport materials is preferably between 10 and 200 weight parts per 100 weight parts of the binder resins. Further, the thickness of the charge transport layer is preferably between 10 and 40 $\mu$m.

The antioxidants, as described herein, means materials, as representative ones, which minimize or retard the action of oxygen under conditions of light, heat, discharging, and the like, with respect to auto-oxidation occurring materials which exist in the electrophotographic photoreceptor or the surface thereof. Specifically, a group of such compounds described below is listed.

(1) Radical Chain Inhibitors

Phenol based antioxidants (hindered phenol based)

Amine based antioxidants (hindered amine based, diallyldiamine based, diallylamine based)

Hydroquinone based antioxidants (hindered phenol based)

(2) Peroxide Decomposing Agents

Sulfur based antioxidants (thioethers)

Phosphoric acid based antioxidants (phosphorous acid esters)

Of said antioxidants, preferred are radical chain inhibitors included in (1). Specifically hindered phenol based or hindered amine base antioxidants are preferable. Further two or more types may be employed in combinations. For example, hindered phenol based antioxidants listed in (1) are preferably employed together with thioether antioxidants listed in (2). Further, antioxidants may be employed in which structural units of said antioxidants such as hindered phenol structural units and hindered amine structural units are incorporated into molecules.

Of said antioxidants, hindered phenol based and hindered amine based antioxidants are specifically effective for minimizing the formation of background stain as well as image blurring under high temperature and high humidity.

The content of hindered phenol based or hindered amine based antioxidants in a resinous layer is preferably between 0.01 to 20 percent by weight. When the content is less than 0.01 weight percent, neither background stain nor image blurring is minimized under high temperature and high humidity. On the other hand, when the content is no less than 20 percent by weight, charge transportability on the resinous layer is degraded, the residual potential tends to increase, and further, the layer strength decreases.

Further, if desired, said antioxidants may be incorporated into a charge generating layer in the lower layer, a charge transport layer, an interlayer, or the like. The added amount of said antioxidants to these layers is preferably between 0.01 and 20 percent by weight with respect to each layer.

The hindered phenols as described herein means compounds having a branched alkyl group in the ortho position relative to the hydroxyl group of a phenol compound and derivatives thereof. (However, the hydroxyl group may be modified to an alkoxy group.)

The hindered amines are compounds having an organic bulky group neighboring to nitrogen atom. An example of the bulky group is branched alkyl group, preferable example of which is t-butyl group. The preferable examples of the compounds having organic group are those represented by the following structural formula:

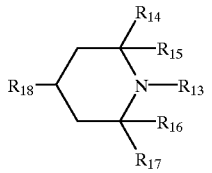

wherein $R_{13}$ represents a hydrogen atom or a univalent organic group, $R_{14}$, $R_{15}$, $R_{16}$, and $R_{17}$ each represents an alkyl group, and $R_{18}$ represents a hydrogen atom, a hydroxyl group, or a univalent organic group.

Listed as antioxidants having a partial hindered phenol structure are compounds described in Japanese Patent Publication Open to Public Inspection No. 1-118137 (on pages 7 to 14).

Listed as antioxidants having a partial hindered amine structure are compounds described in Japanese Patent Publication Open to Public Inspection No. 1-118138 (on pages 7 to 9).

Phosphoric acid compounds include, for example, compounds represented by General Formula RO—P(OR)—OR. Listed as representative compounds are those described below. Incidentally, in said General Formula, R represents a hydrogen atom, and a substituted or unsubstituted group of any of an alkyl group, an alkenyl group or an aryl group.

Organic sulfur compounds include, for example, compounds represented by General Formula R—S—R. Listed as representative compounds are those described below. Incidentally, in the general formula, R represents a hydrogen atom, and a substituted or unsubstituted group of any of an alkyl group, an alkenyl group or an aryl group.

Compound examples of representative antioxidants are listed below.

1-1

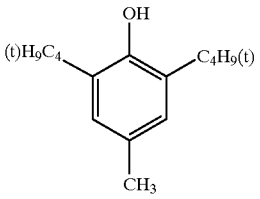

1-2

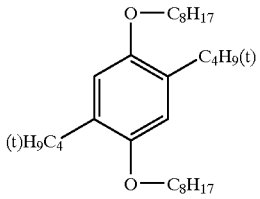

-continued
1-3
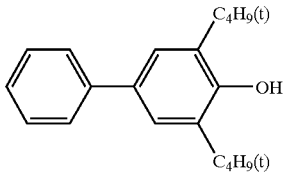
1-4
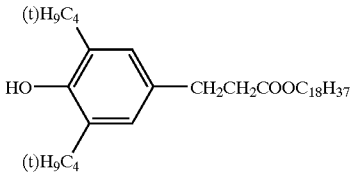
1-5
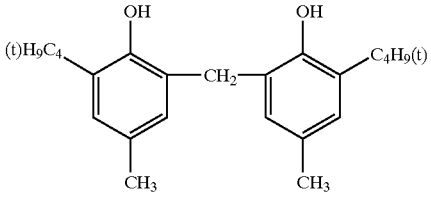
1-6
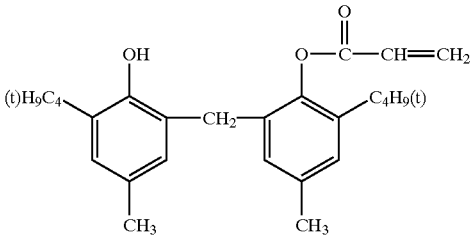
1-7
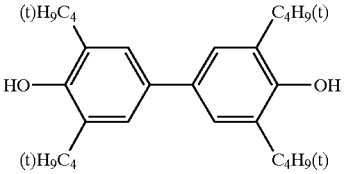
1-8
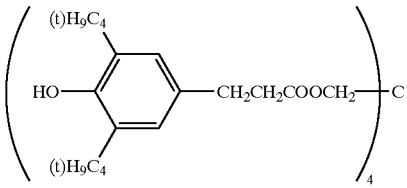
1-9
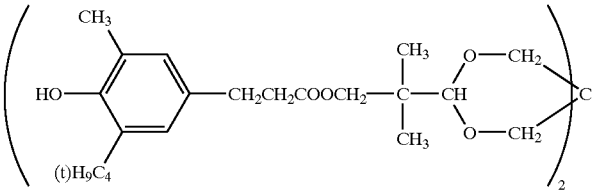
1-10
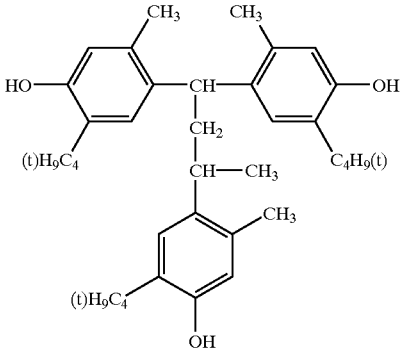
2-1
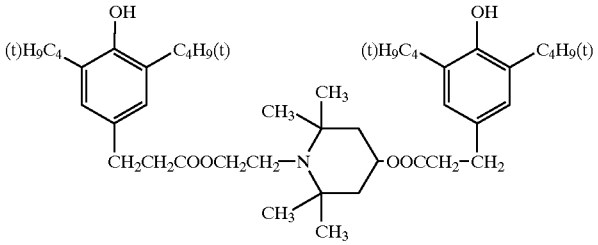
2-2
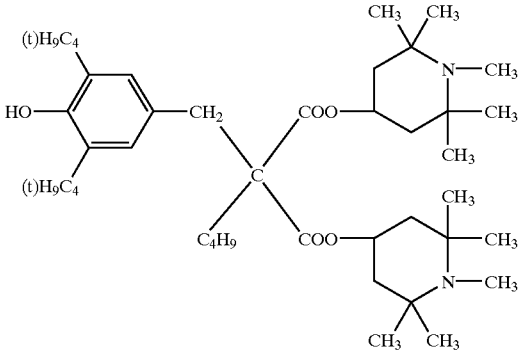

-continued 2-3

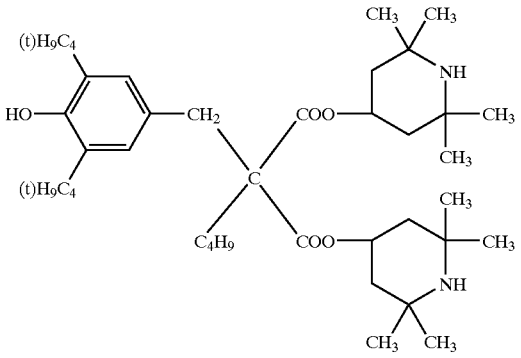

2-4

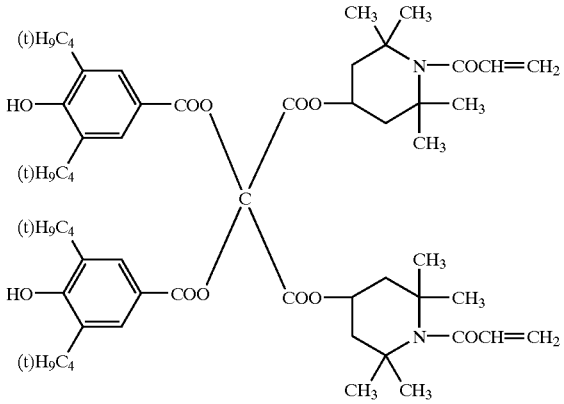

2-5

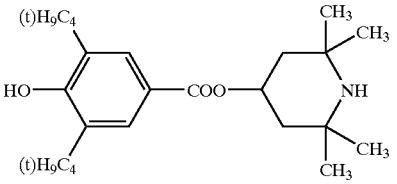

2-6

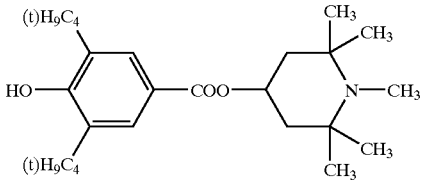

2-7

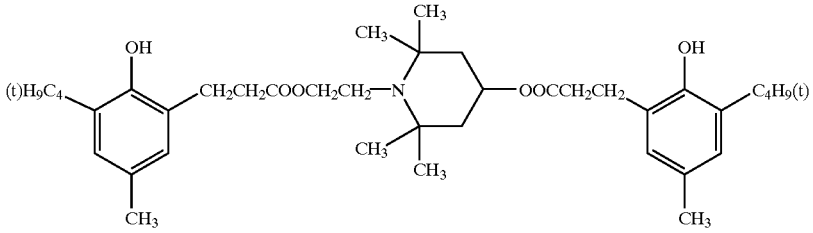

The configuration of the aforementioned hardenable resinous layer and photoreceptor, other than the photosensitive layer, will now be described.

Electrically Conductive Supports

Employed as electrically conductive supports, which are used for the photoreceptor of the present invention, may be those in either sheet or cylinder form. However, in order to design small-sized image forming apparatuses, the electrically conductive cylindrical support is more preferred.

The electrically conductive cylindrical support, as described in the present invention, refers to a cylindrical support which can continuously form images through its rotation. Said electrically conductive support preferably has a circularity of not more than 0.1 mm as well as a fluctuation of not more than 0.1 mm. When the circularity as well as the fluctuation exceed said limit, it becomes difficult to form excellent images.

Next, listed as an electrically conductive materials for the support is metal drum of such as an aluminum, nickel, and the like; a plastic drum having aluminum, indium oxide, tin oxide evaporated, or paper or plastic drum having electric conductive material coated. The resistivity of the conductive support preferably $10^3$ Ωcm or less.

An electric conductive support having anodized aluminum film subjected to sealing process on the surface thereof may be employed. The anodizing process is conducted usually in acidic bath, for example, chromic acid, sulfuric acid, Succinic acid, phosphoric acid, boric acid and sulfamic acid, and most preferable example is anode oxidation process in sulfuric acid. In this instance, it is conducted preferably at condition that content of sulfuric acid is 100 to 200 g/l, content of aluminum ion is 1 to 10 g/l, temperature of bath is around 20 C., and application voltage is 20 volts. The preferable average film thickness is usually 20 μm or less, particularly preferably 10 μm or less.

INTER LAYER

In the present invention, an interlayer, functioning as a barrier, may be provided between the electrically conductive support and the photosensitive layer.

In the present invention, an interlayer may be provided between the electrically conductive support and the photosensitive layer for the purpose of improving adhesiveness between the conductive support and the photosensitive layer, or inhibiting the charge penetration from the support.

Listed as an interlayer are materials for the interlayer such as polyamide resin, vinyl chloride resin, vinyl acetate and copolymer resin having two or more repeating unit of these. Poly amide resin, which can minimize the residual potential after repeating use, is preferable. The thickness of the interlayer is preferably between 0.01 and 0.5 μm.

An example of the inter layer employed in the present invention is an inter layer which has hardened metal resin which is obtained by hardening an organic metal compound such as silane coupling agent, titanium coupling agent and so on. The thickness of the inter layer having hardened resin is preferably 0.1 to 2 μm.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, employed as coating methods to produce the electrophotographic photoreceptor of the present invention may be a dip coating method, a spray coating method, a circular amount regulating type coating method, and the like. In order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in Japanese Patent Publication Open to Public Inspection Nos. 3-90250 and 3-269238, while the above-mentioned circular amount control type coating is detailed in, for example, Japanese Patent Publication Open to Public Inspection No. 58-189061.

The electrophotographic photoreceptor of the present invention may generally be applied to electrophotographic apparatuses such as copiers, laser printers, LED printers, liquid crystal shutter printers, etc. In addition, it may widely be applied to apparatuses for display, recording, offset printing, plate making, facsimile, to which electrophotographic techniques are applied.

Subsequently, the image forming method, which is applied to the electrophotographic photoreceptor of the present invention, will be described with reference to one example.

Precharging exposure process (exposure to eliminate the residual charge on the photoreceptor just prior to image formation): In the precharging exposure process, light irradiation is carried out employing LED, and the like. The precharging exposure retards an increase in the residual potential due to delayed response of the photoreceptor, as well as retards the memory generation due to the exposure pattern. However, the electrophotographic photoreceptor of the present invention is capable of producing consistent images over an extended period of time, in the system having no precharging exposure.

Charging process: Either a corona charging system or a contact charging system may suitably be employed. Specifically, since in the contact charging system, the charging member is brought into direct contact with the electrophotographic photoreceptor, which tends to be damaged, the effects of the photoreceptor of the present invention exhibit pronounced effects. Charge potential onto the photoreceptor is suitably determined depending on the employed photoreceptor. Thus, the photoreceptor is charged during the charging process to obtain the charged voltage of 300 to 1,500 V.

Image exposure process: Suitably employed as exposure light sources may be any of white light, LED, and LD. When an exposure amount becomes excessive, the residual potential tends to increase and pronounced effects of the photoreceptor of the present invention are exhibited. In the case of digital images, LED, as well as LD, is preferably employed as the image exposure light source.

The photoreceptor of the present invention is suited for a digital image exposure system of pulse-width modulation (PWM) which is employed to form middle tone with high image quality.

Said system forms middle tone pixels by modulating the time during which a laser beam irradiates based on image signals. Said system makes it possible to form images with high resolution as well as excellent gradation. Accordingly, said system is specifically suited for a color image forming apparatus which specifically necessitates high resolution as well as excellent gradation. Namely, by utilizing said system, it is possible to carry out area-modulation of the dot formed by each pixel and to express the middle tone without decreasing resolution.

On the contrary, in said PWM, problems occur such that when pixel density is increased, each pixel becomes relatively small with respect to the diameter of an exposure spot, and thus it is impossible to sufficiently achieve gradation due to exposure time modulation. Specifically, problems occur in which, in spite of the fact that in the conventional electrophotographic photoreceptor, a light spot area is minutely divided, final images do not fully exhibit advantages of said PMW due to insufficient conditions of latent images formed on the photoreceptor as well as development. Namely, light carriers, which are employed to form latent images, are subjected to diffusion during running in the photosensitive layer. As a result, image information provided with light spots is degraded and electric potential contrast generated by formed latent images is decreased due to the space which exists up to the eclectically conductive support. Thus, based on the phenomena as described above, it is supposed that image quality is degraded due to the large degradation of image information provided with initial light spots.

In order to overcome the problems as described above, the photoreceptor of the present invention is created as follows. Since the photoreceptor of the present invention comprises a photosensitive layer having thereon a hardenable resinous layer which comprises structural units having charge transportability as well as a cross-linking structure, it is possible to design the reduced thickness of said photosensitive layer and said hardenable resinous layer. Further, the time response properties of surface electric potential decay, after light irradiation, is sufficiently rapid. As a result, even though said light spot area is minutely divided, it is possible to form latent images without degrading given image information.

In an image forming method or apparatus in which image exposure is carried out employing a light beam having a spot area of not more than 2,000 $\mu$m , the photoreceptor of the present invention can sufficiently exhibit its advantages. Though a light beam having said spot area of not more than 1,000 $\mu m^2$ is employed, the image forming method or apparatus employing the photoreceptor of the present invention can sufficiently form images corresponding to said spot area.

Even when the photoreceptor of the present invention, specifically one having a hardenable resinous layer, has a total thickness of said photosensitive layer and said hardenable resinous layer of not more than 15 $\mu$m, it is possible to sufficiently satisfy the properties of the response time of the present invention of not more than 0.25 second. As a result, even though the minute light beam having such a spot area of not more than 1,000 $\mu m^2$ is employed, it is possible to more faithfully form latent images based on said light beam. Subsequently, it is possible to achieve excellent image quality having no less than 400 dpi, as well as 256 gradations.

The spot area of said light beam, as described herein, is expressed by the area corresponding to a light intensity of not more than $1/e^2$ of the intensity of said light beam.

Listed as employed light beams are scanning optical systems employing a semiconductor laser, solid scanners such as LED, liquid crystal shutters, and the like. Regarding light intensity distributions, there are the Gauss distribution, Lorenz distribution, and the like, and an area having an intensity of not more than $1/e^2$ of each peak is designated as said spot area.

Development process: In the development process, it is possible to employ either a single or a double component developer, and it is also possible to suitably employ either a magnetic or a non-magnetic toner. Specially, the photoreceptor of the present invention, having high hardness as well as excellent time response properties, can exhibit its advantages in a high speed image forming method or apparatus having a short processing time from the aforementioned image exposure process to said development process, or an image forming method or apparatus employing a cylindrical photoreceptor having a relatively small diameter.

Namely, one of the image forming methods or apparatuses, employing the photoreceptor of the present invention, is characterized in that after said photoreceptor is subjected to image exposure during the image exposure process, in the subsequent development process, the duration until the development is initiated, is not more than 100 milliseconds. It is possible to apply said image forming method or apparatus to design a high speed copier or printer processing at least 40 A4 sheets per minute as well as a small-sized copier or printer employing a cylindrical photoreceptor having a diameter of not more than 30 mm, so that detailed images are faithfully reproduced.

Transfer process: Any transfer system employing a corona transfer, a roller transfer, and an intermediate transfer material is suitably employed in the transfer process. Since in the corona transfer, paper dust tends to be electrostatically adhered, the marked effects of the photoreceptor of the present invention are exhibited.

Separation process: Since an electrophotographic photoreceptor formed on a cylindrical support having a very large diameter specifically exhibits inferior separation properties, claw separation is effectively employed. However, when such a claw separation system is utilized, said electrophotographic photoreceptor is susceptible to effects of claw abrasion due to the contact of the separation claw. Therefore, the electrophotographic photoreceptor of the present invention exhibits highly desirable effects in the claw separation process.

Cleaning process: Common cleaning blades are suitably employed. Further, employed as auxiliary members for cleaning may be fur brushes and rollers. Since cleaning conditions largely affect the wear of a photoreceptor, use of the electrophotographic photoreceptor of the present invention allows for widely adaptable cleaning processes.

Fixing process: Thermal fixing is preferred, employing, for example, heated roller fixing, flash fixing, and the like.

The image forming method, to which the photoreceptor of the present invention is applied, is basically applied to the image forming processes described above, and further applied to applied or developed processes.

For example, the photoreceptor of the present invention may be applied to a color image forming method in which for color development, a plurality of charging units and development units are disposed around the photoreceptor.

Further, as for the transfer process, application is carried out for a process which utilizes an intermediate transfer body.

The cleaning process may be added with auxiliary cleaning mechanism as well as a process exhibiting a paper dust removing function.

A cleaning process, as well as the developer material, will be described which significantly relate to the effects of the present invention, especially for a decrease in the layer thickness of the photoreceptor, filming, and the like, among said image forming processes.

<<Properties of the Cleaning Blade and Contact Conditions>>

The cleaning means employed in the present invention is one which is provided with a blade-shaped cleaning member which is arranged to be in pressure contract with the photoreceptor. By employing said cleaning blade, the residual toner on the photoreceptor, which has not been transferred, is removed. From the viewpoint of improvement of cleaning properties, said cleaning blade is preferably brought into contact with the photoreceptor under conditions of a pressure contact force P' of 5 to 50 g/cm in terms of linear pressure. When said pressure contact force P' is less than 5 g/cm, the toner tends not to be completely removed, while when said pressure contact force P' is no less than 50 g/cm, blade curl tends to result. Pressure contact methods include a method in which a pressure contact position is previously determined and the blade is then stationarily fixed, a method in which load is adjusted employing a weight, a method employing a spring, and the like. Of these, in order to minimize the fluctuation of the pressure contact force, the weight load method is preferred.

Incidentally, during a pre-stage of the cleaning process, in order to facilitate cleaning, a charge eliminating process, which eliminates charges on the photoreceptor surface, is preferably added. Said charge eliminating process is carried out employing, for example, a charge eliminator which results in alternative current corona discharge.

The cleaning blade employed in the present invention is preferably comprised of elastic rubber materials having a hardness of 65° to 75° and an impact resilience of 15 to 60 percent (at 20° C. and 50±5 percent RH). When the impact resilience is less than 15 percent, the bounding of said blade tends to occur and at an ambience of relatively low temperature, it is difficult to maintain desired cleaning properties. On the other hand, when the impact resilience exceeds 75 percent, said blade tends to increase in the following properties and blade curl tends to occur (physical property parameters, hardness and impact resilience, of the elastic body rubber blade employed in said cleaning blade are measured employing JIS K6301 Vulcanized Rubber Physical Test Method.).

Silicon rubber, urethane rubber etc. are employed for the cleaning blade, and urethane rubber is preferable.

Toners employed in the invention will be described.

TONER EMPLOYED IN THE INVENTION

<Shape Coefficient of the Toner>

The shape coefficient of the toner particles of the present invention is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient is determined in such a manner that toner particles are photographed under a magnification factor of 2,000, employing a scanning type electron microscope, and the resultant photographs are analyzed employing "Scanning Image Analyzer", manufactured by Nihon Denshi Co. At that time, 100 toner particles are employed and the shape coefficient of the present invention is obtained employing the aforementioned calculation formula.

The polymerized toner of the present invention is that the number ratio of toner particles in the range of said shape coefficient of 1.2 to 1.6 is preferably at least 65 percent and is more preferably at least 70 percent.

By adjusting the number ratio of toner particles in the range of a shape coefficient of 1.2 to 1.6 to at least 65 percent, the triboelectrical properties become more uniform on the developer conveying member resulting in no accumulation of excessively charged toner particles, and said toner particles are more readily replaced from the surface of said developer conveying member to minimize the generation of problems such as development ghost and the like. Further, the toner particles tend not to be crushed, resulting in decreased staining on the charge providing member and chargeability of the toner is stabilized.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

The variation coefficient of the polymerized toner, which is preferably employed in the present invention, is calculated using the formula described below:

<Variation Coefficient of the Toner>Variation coefficient of the toner is calculated by the formula.

$$\text{Variation coefficient}=(S/K)\times 100\ \text{(in percent)}$$

wherein S represents the standard deviation of the shape coefficient of 100 toner particles and K represents the average of said shape coefficient.

Said variation coefficient of the shape coefficient is generally not more than 16 percent, and is preferably not more than 14 percent.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by Toa Iyodenshi Co.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

<Number Variation Coefficient of the Toner>

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/D_n)\times 100\ \text{(in percent)}$$

wherein S represents the standard deviation in the number particle size distribution and $D_n$ represents the number average particle diameter (in $\mu$m).

Effect of the Number Variation Coefficient

The number variation coefficient of the toner of the present invention is not more than 27 percent, and is preferably not more than 25 percent. By adjusting the number variation coefficient to not more than 27 percent, voids of the transferred toner layer decrease to improve fixability and to minimize the formation of offsetting. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

The diameter of the toner particles of the present invention is preferably between 3 and 8 $\mu$m in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 $\mu$m, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The polymerized toner, which is preferably employed in the present invention, is as follows. The diameter of toner particles is designated as D (in $\mu$m). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m^2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 $\mu$m (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

When a toner is prepared employing a pulverization method, the ratio of toner particles having a shape coefficient of 1.2 to 1.6 is approximately 60 percent by number. The variation coefficient of said shape coefficient is approximately 20 percent. Further, the number variation coefficient in the number particle size distribution is approximately 30 percent when one classification operation is carried out after pulverization, and in order to control the number variation coefficient below 27 percent, it is required to repeat the classification operation.

When toner is prepared employing a suspension polymerization method, conventionally, the polymerization is carried out in a laminar flow, resulting in toner particles having a nearly spherical shape. For example, in the toner described in Japanese Patent Publication Open to Public Inspection No. 56-130762, the ratio of toner particles having a shape coefficient of 1.2 to 1.6 is approximately 20 percent by number, and the variation coefficient of the shape coefficient is approximately 18 percent, while the ratio of toner particle have no corners is approximately 85 percent by number. Furthermore, as previously described in the method which controls a number variation coefficient in the number particle size distribution, large oil droplets comprised of polymerizable monomers are subjected to repeated mechanical shearing to reduce the size of the droplets to nearly a similar size as the desired toner particles. Therefore, the distribution of oil droplet diameter is broadened. As a result, the particle size distribution of the resulting toner widens. Therefore, in order to decrease the number variation coefficient, a classification operation is required.

When toner is prepared employing the polymerization method in which resin particles are associated or fused, for example, toner described in Japanese Patent Publication Open to Public Inspection No. 63-186253 comprises approximately 60 percent by number of toner particles having a shape coefficient of 1.2 to 1.6, its variation coefficient of the shape coefficient is approximately 18 percent. Further, the particle size distribution of said toner is wide and the number variation coefficient is 30 percent. Accordingly, in order to decrease the number variation coefficient, a classification operation is required.

The average particle diameter of the toner obtained by fusing colored particles is preferably between 3 and 8 $\mu$m. The volume average particle diameter of the toner may be measured employing a Coulter Counter TA-II, a Coulter Multisizer or SLAD1100, a laser diffraction particle size analyzer manufactured by Shimadzu Mfg., Co., LTD. The average particle size is measured in the particle size range of 2.0 to 40 $\mu$m by employing an aperture of 100 $\mu$m when using Coulter Counter TA-II, a Coulter Multisizer.

The toner preferably contains less than 30 number % or less toner particles having particle diameter of not more than 3.0 $\mu$m. In the pulverization/classification method, pulverization may be conducted with restraining excess pulverization. Classification can be repeatedly operated. In the polymerization method, the preparation by suspension polymerization or fusing method may be preferable.

In the polymerization method, fine particles can be removed by centrifugal separation of the resin particles in the dispersion.

The invention is attained independent on the preparation method, pulverization or polymerization. Preparation of Toner employed in the Invention The toner to be used in the invention may be produced by a usually applied pulverization method by which a binder resin, a colorant, and additives to be added according to necessity are kneaded, crushed and classified, or a method in which the toner resin particle containing a mold releasing agent and a colorant is synthesized in a medium.

Listed as methods for fusing fine resin particles in a water-based medium may be those described in, for example, Japanese Patent Publication Open to Public Inspection Nos. 63-186253, 63-282749, 7-146583, and others. Listed as the most preferable fusing method is one in which fine resin particles are subjected to salting-out/fusing in a water-based medium.

The weight average particle diameter of fine resin particles, which are employed to obtain the toner of the present invention, is preferably between 50 and 2,000 nm. Such fine resin particles may be obtained employing any of the several granulation polymerization methods such as an emulsion polymerization method, a suspension polymerization method, a seed polymerization method, and the like. The preferred are fine resin particles which are obtained employing the emulsion polymerization method.

A monomer to be used for production of the resin is described below. A known polymerizable monomer can be used in both of the methods by the kneading, crushing and classifying and by the synthesizing the toner resin particle in the medium. One or more kinds of the monomer may be used in combination to satisfy required properties.

A generally known binder resin such as a styrene resin, an acryl resin, a styrene-acryl resin, a polyester resin, a styrene-butadiene resin, and an epoxy resin maybe used without any limitation.

The monomers for constituting the styrene resin, the acryl resin and the styrene-acryl resin include the followings: a styrene and a styrene derivative such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecyl styrene; a methacrylic ester derivative such as methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate; and an acrylic ester derivative such as methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate, phenyl acrylate, dimethylaminoethyl acrylate, and diethylaminoethyl acrylate. These monomers may be used solely or in combination.

Monomers usable in another vinyl polymer include the followings: an olefin such as ethylene, propylene, and isobutylene; a halogenized vinyl compound such as vinyl chloride, vinylidene chloride, vinyl bromide, vinyl fluoride, and vinylidene fluoride; a vinyl ester such as vinyl propionate, vinyl acetate, and vinyl benzoate; a vinyl ether such as vinyl methyl ether, and vinyl ethyl ether; a vinyl ketone such as vinyl methyl ketone, vinyl ethyl ketone, and vinylhexyl ketone; an N-vinyl compound such as N-vinylcarbazole, N-vinylindole, and N-vinylpyrrolidone; a vinyl compound such as vinylnaphthalene, and vinylpyridine; and a derivative of acrylic acid and methacrylic acid such as acrylonitrile, methacrylonitrile, N-butylacrylamide, N,N-dibutylacrylamide, methacrylamide, N-butylmethacrylamide, and N-octadecylacrylamide. These vinyl monomers may be used solely or in combination.

Examples of monomer to obtain a carbonic acid polymer of styrene-acryl resin (vinyl resin) include acrylic acid methacrylic acid, α-ethylacrylic acid, fumaric acid, maleic acid, itaconic acid, cinnamic acid, monobutyl maleate, monooctyl maleate, cinnamic anhydride, and a methyl half ester of alkenylsuccinic acid.

A crosslinking agent such as vinylbenzene, ethylene glycol diacrylate, diethylene glycol diacrylate, triethylene glycol diacrylate, ethylene glycol dimethacrylate, diethylene glycol dimethacrylate, and triethylene glycol dimethacrylate.

The polyester resin is a resin produced by the condensation polymerization of a di- or more-valent carbonic acid component and a di- or more-valent alcohol component. Examples of the di-valent carboxylic acid include maleic acid, fumaric acid, citraconic acid, itaconic acid, glutaconic acid, phthalic acid, isophthalic acid, terephthalic acid, succinic acid, adipic acid, sebacic acid, azelaic acid, malic acid, n-dodecylsuccinic acid, n-dodecenylsuccinic acid, isododecylsuccinic acid, n-octylsuccinic acid, and n-octenylsuccinic acid. Anhydride compounds of those are also usable.

Examples of di-valent alcohol constituting the polyester resin include an etherized bisphenol such as polyoxypropylene (2,2)-2,2-bis(4-hydroxyphenyl)propane, polyoxypropylene(3,3)-2,2-bis(4-hydroxyphenyl)propane, polyoxypropylene(2,0)-2,2-bis(4-hydroxyphenyl)propane, polyoxypropylene(2,0)-polyoxyethylene(2,0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanedimethanol, dipropylene glycol, polyethylene glycol, polypropylene glycol, polytetramethylene glycol, bisphenol A, bisphenol Z, and hydrogenated bisphenol A.

Examples of monomer of a polyester resin having a cross-linked structure include the following tri-valent carboxylic acid such as 1,2,4-benzenetricarboxylic acid, 2,5,7-naphthalene tricarboxylic acid, 1,2,4-naphthalene tricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and an empoletrimer acid. The cross-linked polyester resin may also be produced by addition of an anhydride compound of these acids, or a poly-valent alcohol such as sorbitol, 1,2,3,6-hexanetetrol, 1,4-solbitol, pentaerythritol, dipentaerythritol, tripentaerythritol, 1,2,4-pentanetriol, 1,2,5-pentanetriol, glycerol, 2-methylpropane triol, 2-methyl-1,2,4-butanetriol, trimethylolethane, trimethylolpropane, and 1,3,5-trihydroxymethylbenzene.

Inorganic pigment and organic pigment can be employed for coloring agent.

Arbitrary inorganic pigment can be employed. Practical inorganic pigment is listed below.

Carbon black such as furnace black, channel black, acetylene black, thermal black and lamp black is exemplified as black pigment. Magnetic powders such as magnetite and ferrite are employed for black pigment.

These inorganic pigments can be used individually or two or more in combination optionally selected according to needs. And the content of pigment is usually 2–20 mass %, and preferably, 3–15 mass % of polymer.

The above-mentioned magnetite can be employed to use as magnetic toner. It is preferable to employ 20–60 mass % of magnetite in toner from a point of view to give predetermined magnetic characteristics in this case.

An organic pigment can be also employed. Practical organic pigment is exemplified below.

Magenta or Red Pigment

C.I. Pigment red 2, C.I. Pigment red 3, C.I. Pigment red 5, C.I. Pigment red 6, C.I. Pigment red 7, C.I. Pigment red 15, C.I. Pigment red 16, C.I. Pigment red 48:1, C.I. Pigment red 53:1, C.I. Pigment red 57:1, C.I. Pigment red 122, C.I. Pigment red 123, C.I. Pigment red 139, C.I. Pigment red 144, C.I. Pigment red 149, C.I. Pigment red 166, C.I. Pigment red 177, C.I. Pigment red 178, and C.I. pigment red 222.

Orange or Yellow Pigment

C.I. Pigment orange 31, C.I. Pigment orange 43, C.I. Pigment yellow 12, C.I. Pigment yellow 13, C.I. Pigment yellow 14, C.I. Pigment yellow 15, C.I. Pigment yellow 17, C.I. Pigment yellow 93, C.I. Pigment yellow 94, C.I and Pigment yellow 138.

Green or Cyan Pigment

C.I. Pigment blue 15, C.I. Pigment blue 15:2, C.I. Pigment blue 15:3, C.I. Pigment blue 16, C.I. Pigment blue 60 and C.I. pigment green 7.

These organic pigments can be used individually or two or more jointly selected according to needs. And content of pigment is 2–20 mass % and preferably 3–15 mass % for polymer.

The colorant subjected to surface modification can be employed. The practical surface modifying agent includes silane coupling agent, titanium coupling agent and aluminum coupling agent.

So-called outer additive is added to toner of the present invention for a purpose of improvement of fluidity, charging characteristics and cleaning characteristics. Various kinds of inorganic fine particles, organic fine particles and lubricant can be employed.

Conventional materials may be employed for the inorganic fine particles. Fine particles of silica, titanium alumina etc. are employed preferably in practice. The fine particles are preferably hydrophobic. As fine particles of silica R-805, R-976, R-974, R-972, R-812 and R-809 manufactured by Nihon Aerosil Co., Ltd., HVK-2150 and H-200 manufactured by Hoechst company, TS-720, TS-530, TS-610, H-5 and MS-5 manufactured by Cabot company, are mentioned as practical example.

As titanium fine particle, T-805 and T-604 manufactured by Nihon Aerosil Co., Ltd., MT-100S, MT-100B, MT-500BS, MT-600, MT-600SS and JA-1 manufactured by TAYCA Corporation, TA-300, SI TA-500, TAF-130, TAF-510 and TAF-510T manufactured by Fuji titanium company, IT-S, IT-OA, IT-OB and IT-OC manufactured by Idemitsu Kosan company, are mentioned for example.

As alumina fine particle, RFY-C and C-604 manufactured by Nihon Aerosil Co., Ltd., TTO-55 of manufactured by ISHIHARA SANGYO KAISHA, LTD. are given for example.

Spherical organic fine particles having number average primary particle diameter around 10–2000 nm can be employed. Homopolymer such as styrene or methyl methacrylate and copolymer of these can be used.

As lubricant, for example, stearic acid salt of such as zinc, aluminum, copper, magnesium and calcium, salt of oleic acid of such as zinc, manganese, iron, copper and magnesium, palmitic acid salt of such as zinc, copper, magnesium and calcium, linoleic acid salt of such as zinc and calcium, ricinoleic acid salt of such as zinc and calcium, and metal salt of higher fatty acid are given.

Content of this outer additive is preferably around 0.1 to 5 mass % for toner.

In the toner preparation process the above mentioned additives may beaded to the toner particles obtained by above process, for the purpose of, for example, improving fluidity, charging characteristics and cleaning characteristics.

In order to add said additives various mixers, which are known in the art, such as a tubular mixer, a Henschel mixer, a Nauter mixer, a V-shaped mixer, and the like may be employed.

The toner may contain, in addition to binder resin and colorant, materials giving various function. Practically, releasing agent and charge controlling agent are exemplified.

Specifically, examples of the releasing agent includes conventional one, practically, olefin waxes such as polypropylene and polyethylene, or denaturation thereof, natural waxes such as carnauba wax and rice wax, amide wax such as fatty acid bisamide, and the like. It is preferred that these are added as a releasing agent and are subjected to salting out/fusing together with resin or colorant as mentioned above.

In the same manner, it is possible to use various charge control agents which are known in the art and are capable of being dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof, and the like.

<Developers>

The toner of the present invention may be employed as either a single component developer or a two-component developer. However, it is preferably employed as a two-component developer.

When employed as a single component developer, there is a method in which said toner is employed as a non-magnetic single component developer without any further alteration. Generally, however, magnetic particles having a size of about 0.1 to about 5 $\mu$m are incorporated into toner particles and employed as a magnetic single component developer. As the incorporation method, magnetic particles are incorporated into non-spherical particles in the same manner as for colorants.

Further, the toner is blended with a carrier, and can be employed as a two-component developer. In such case, employed as magnetic particles of the carrier are conventional materials, known in the art, such as iron, ferrite, magnetite, and the like, as well as alloys of such metal with other metals such as aluminum, lead, and the like. Of these, ferrite is specifically preferred. Said magnetic particles preferably have a volume average diameter of 15 to 100 $\mu$m, and more preferably have one between 25 to 60 $\mu$m.

The volume average particle diameter of said carrier is typically measured employing a laser diffraction type particle distribution meter, "HELOS", (manufactured by Sympatec Co.) provided with a wet type homogenizer.

The carrier is preferably one which is obtained by further coating resin onto magnetic particles, or a so-called resin-dispersed type carrier which is obtained by dispersing magnetic particles into resin. Resin compositions for coating are not particularly limited. For example, employed are olefin based resins, styrene based resins, styrene/acryl based resins, silicone based resins, ester based resins, fluorine containing polymer based resins, and the like. Further, resins to compose the resin-dispersed type carrier are also not particularly limited, and any of those known in the art may be employed. For example, employed may be styrene acrylic resins, polyester resins, fluorine based resins, phenol resins, and the like.

FIG. 1 is a schematic view showing the entire structure of the image forming apparatus of the present invention.

The image forming apparatus shown in FIG. 1 is one employing a digital system, and is comprised of image reading section A, image processing section B (not shown), image forming section C, and transfer paper conveying section D as the transfer paper conveying means.

In the upper part of image reading section A, provided is an automatic document conveying means which automatically conveys the original documents. Original documents, which are placed on document platen 11, are conveyed sheet by sheet and conveyed by original document conveying roller 12, and image reading is carried out at reading position 13*a*. The original document, which has been read, is ejected onto document ejecting tray 14, utilizing document conveying roller 12.

On the other hand, the image of the original document, which is placed on platen glass 13, is read by reading operation at a speed of v of first mirror unit 15 comprised of an illuminating lamp and a first mirror which constitutes an optical scanning system and by movement at a speed of v/2 in the same direction of second mirror unit 16 comprised of a second mirror and a third mirror which are positioned in a V letter.

The read image is focused through projection lens 17 onto the receptor surface of imaging sensor CCD of a line sensor. The linear optical image, which has been focused onto the imaging sensor CCD, is successively subjected to photoelectric conversion to obtain electric signals (brightness signals), and thereafter, is subjected to A/D conversion. The resultant signals are then subjected to various processes such as density conversion, a filtering process, and the like in image processing section B, and then the resultant image data are temporarily stored in a memory.

In image forming section C, arranged as image forming units are drum-shaped image bearing photoreceptor (hereinafter referred to as a photoreceptor drum) 21, and around said photoreceptor drum, charging unit 22 as the charging means, development unit 23 as the development means, transfer unit 24 as the transfer means, separating unit 25 as the separating means, cleaning unit 26 and PCL (pre-charge lamp) 27 in said order for each cycle. Photoreceptor 21 is prepared by applying photoconductive compounds onto a drum base body. For example, organic photoconductors (OPC) are preferably employed. Said drum rotates clockwise as shown in FIG. 1.

After rotating the photoreceptor is uniformly charged employing charging unit 22, image exposure is carried out based on image signals retrieved from the memory of image processing section B, employing exposure optical system 30. In said exposure optical system 30 which is utilized as the writing means, a laser diode (not shown) is employed as the light emitting source, and primary scanning is carried out in such a manner that light passes through rotating polygonal mirror 31, an fθ lens (having no reference numeral), and a cylindrical lens (also having no reference numeral), and the light path is deflected by reflection mirror 32. As a result, image exposure is carried out at position $A_0$ with respect to photoreceptor 21, and a latent image is formed by the rotation (secondary scanning) of photoreceptor 21. In one example of the present embodiment, exposure is carried out for a text section and the latent image is formed.

The latent image on photoreceptor 21 is subjected to reversal development employing development unit 23, and a visualized toner image is formed on the surface of said photoreceptor 21. In transfer sheet conveying section D, under the image forming unit provided are sheet supply units 42(A), 41(B), and 41(C) as paper sheet storing means, in which different-sized paper sheets P are stored, and provided on the exterior, is manual paper sheet supply unit 42 by which paper sheets are manually supplied. Paper sheet P, which is selected from any of these paper sheet supply units is conveyed along conveying path 40 employing paired guide rollers 43, and the conveyance of the paper sheet P is temporarily suspended by paired register rollers 44 which correct the inclination as well as the deviation of the paper sheet P, and thereafter the conveyance resumes again. Paper sheet P is guided by conveyance path 40, paired pre-transfer rollers 43*a*, and guide plate 46 so that the toner image on photoreceptor 21 is transferred onto paper sheet P at transfer position $B_0$ employing transfer unit 24. Subsequently, charge elimination is carried out employing separation unit 25; paper sheet P is separated from the surface of the photoreceptor 21 and is conveyed to fixing unit 50, employing conveying unit 45.

Fixing unit 50 comprises fixing roller 51 as well as pressure roller 52. By passing paper sheet P between fixing roller 51 and pressure roller 52, heat as well as pressure is applied to melt-fix the toner. Paper sheet P, which has been subjected to fixing of its toner image, is ejected onto paper sheet ejecting tray 64.

Figure 2:
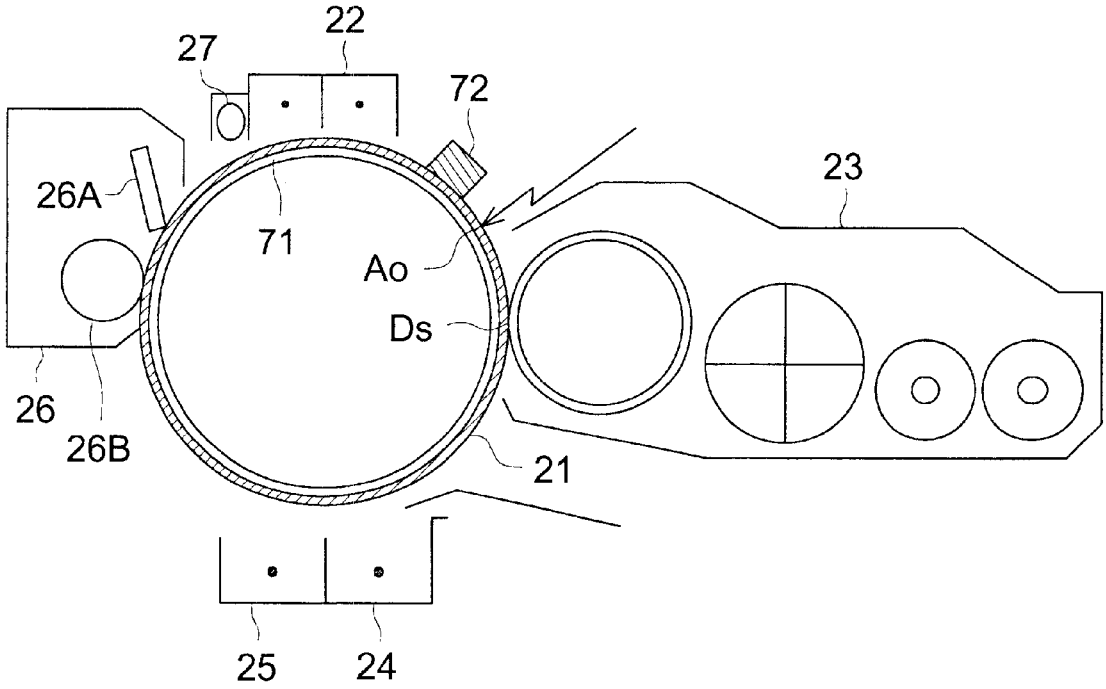
FIG. 2 is a front view showing the constitution of the photoreceptors and its peripherals in the image forming apparatus of the present invention.

FIG. 2 is a front view showing photoreceptor and its circumferential devices of the image forming apparatus of the invention. In the FIG. 2, numeral 21 denotes a photoreceptor, 71 denotes a heater provided interior of the photoreceptor to heat the photoreceptor, and 71 is a thermosensor provided in contact with or adjacent to the photoreceptor to detect the temperature of the photoreceptor Time from the image exposure to starting of development corresponds to the time necessary for rotation of the photoreceptor from the exposing point Ao to the point of starting of development Ds, in the FIG. 2. The environmental detector 73 is provided in attaching to the image forming apparatus to detect the environmental condition. The detector is composed of thermal sensor to detect the environmental temperature and humidity sensor to detect the environmental humidity.

EXAMPLES

The present invention will now be detailed with reference to examples. "Parts" in the following description is by weight, unless otherwise indicated.

Examples 1 through 3 and Comparative Examples 1 through 3

Preparation of Photoreceptor 1

Photoreceptor 1 was prepared as described below.

<Sublayer>

| | |
|---|---|
| Titanium chelate compound (TC-750, manufactured by Matsumoto Seiyaku) | 30 g |
| Silane coupling agent (KBM-503, manufactured by Shin-Etsu Kagaku Co.) | 17 g |
| 2-Propanol | 150 ml |

The aforementioned coating composition was applied onto an electrically conductive ϕ60 mm cylindrical support with so as to obtain a dried layer thickness of 0.5 μm.

<Charge Generating Layer>

| | |
|---|---|
| Y type titanyl phthalocyanine (the maximum peak angle of X-ray diffraction utilizing Cu-α characteristic X-ray is 27.3 degrees in terms of 2θ) | 60 g |
| Silicon modified butyral resin (X-40-1211M, manufactured by Shin-Etsu Kagaku Co.) | 700 g |
| t-Butanol | 1600 ml |
| 2-Methoxymethylpentanone | 400 ml |

were mixed and dispersed for 10 hours employing a sand mill to prepare a charge generating coating composition. The resulting coating composition was applied onto the aforementioned sublayer employing a dip coating method, and a charge generating layer having a dried layer thickness of 0.2 μm was formed.

<Charge Transport Layer>

| | |
|---|---|
| Charge transport material (T-18) | 200 g |
| Polycarbonate (Z-300, manufactured by Mitsubishi Gas Kagaku Co.) | 300 g |
| Antioxidant (Exemplified Compound 1-3) | 5 g |
| Dichloromethane | 2000 ml |

were mixed and dissolved to prepare a charge transport layer. The resulting coating composition was applied onto the aforementioned charge generating layer employing a dip coating method. Thus a charge transport layer having a dried layer thickness of 20 μm, shown in Table 1, was formed. The ionization potential of said charge transport layer was 5.40 eV.

<Hardenable Resinous Layer>

| | |
|---|---|
| Methyltrimethoxysilane | 180 g |
| Compound (Exemplified Compound B-1) | 60 g |
| Antioxidant (Exemplified Compound 2-1) | 1 g |
| 2-Propanol | 225 g |
| 3 percent Acetic acid | 30 g |
| Trisacetylacetonataluminum | 3 g |

Methyltrimethoxysilane, 2-propanol, and 3 percent acetic acid, each having the weight as described above, were mixed and stirred at room temperature for 16 hours to prepare the oligomer liquid medium of a silane compound. Subsequently, Exemplified Compound T-1, Antioxidant, and trisacetylacetonataluminum, each having the weight as described above, were added to said oligomer liquid medium, and the resulting mixture was stirred for 2 hours. Subsequently, it was filtered and a hardenable resinous layer coating composition was prepared. The resulting coating composition was applied onto the aforementioned charge transport layer, employing a circular amount-regulating coating device so as to form a hardenable resinous layer having a dried layer thickness of 2.5 μm. The resulting coated layer was thermally hardened at 110° C. for one hour to form a siloxane based resinous layer having a cross-linking structure . Thus Photoreceptor 1 was prepared. The ionization potential of the resulting hardenable resinous layer was 5.51 eV. Accordingly, the difference in the ionization potential between the hardenable resinous layer of Photoreceptor 1 and the charge transport layer was 0.11 eV.

Preparation of Photoreceptor 2

The hardenable resinous layer of Photoreceptor 1 was altered, as described below, and Photoreceptor 2 was prepared.

<Hardenable Resinous Layer>

| | |
|---|---|
| Methyltrimethoxysilane | 100 g |
| Dimethoxymethylsilane | 82 g |
| Exemplified Compound (B-1) | 60 g |
| Antioxidant (Exemplified Compound 2-1) | 1 g |
| 2-Propanol | 225 g |
| 3 percent Acetic acid | 30 g |
| Dibutyl tin acetate | 3 g |

Methyltrimethoxysilane, dimethoxydimethylsilane, 2-propanol, and 3 percent acetic acid, Exemplified Compound T-1, antioxidant, dibutyl tin acetate, each having the weight as described above, were simultaneously mixed and stirred for 2 hours. Thereafter, it was filtered and a hardenable resinous layer coating composition was prepared. The resulting coating composition was applied onto the aforementioned charge transport layer, employing a circular amount regulating coating device so as to form a hardenable resinous layer having a dried layer thickness of 2.5 μm. The resulting coated layer was thermally hardened at 110° C. for one hour to form a siloxane based resinous layer having a cross-linking structure . Thus Photoreceptor 2 was prepared. The ionization potential of said hardenable resinous layer was 5.62 eV. Accordingly, the difference in the ionization potential between the hardenable resinous layer of Photoreceptor 2 and the charge transport layer was 0.22 eV.

Preparation of Photoreceptor 3

The charge transport layer of Photoreceptor 1 was altered as described below, and Photoreceptor 3 was prepared.

<Charge Transport Layer>

| | |
|---|---|
| Charge transport material (T-20) | 200 g |
| Polycarbonate (Z-300, manufactured by Mitsubishi Gas Kagaku Co.) | 300 g |
| Antioxidant (Exemplified Compound 1-3) | 5 g |
| Dichloromethane | 2000 ml |

were mixed and dissolved to prepare a charge transport coating composition. The resulting coating composition was applied onto the aforementioned charge generating layer, employing a dip coating method to form a charge transport layer having a dried layer thickness of 20 μm.

The ionization potential of said charge transport layer was 5.60 eV. Since as the hardenable resinous layer, one which was the same as that of Photoreceptor 1, was provided, the difference in ionization potential was 0.09 eV.

Preparation of Photoreceptor 4

The charge transport layer of Photoreceptor 1 was altered as described below, and Photoreceptor 4 was prepared.

<Charge Transport Layer>

| <Charge Transport Layer> | |
|---|---|
| Charge transport material (T-16) | 200 g |
| Polycarbonate (Z-300, manufactured by Mitsubishi Gas Kagaku Co.) | 300 g |
| Antioxidant (Exemplified Compound 1-3) | 5 g |
| Dichloromethane | 2000 ml |

were mixed and dissolved to prepare a charge transport coating composition. The resulting coating composition was applied onto the aforementioned charge generating layer, employing a dip coating method to form a charge transport layer having a dried layer thickness of 20 μm.

The ionization potential of said charge transport layer was 5.05 eV. Since as the hardenable resinous layer, one which was the same as that of Photoreceptor 1, was provided, the difference in ionization potentials was 0.46 eV.

Preparation of Photoreceptor 5

A charge transport layer and its underlying layers were prepared in the same manner as Photoreceptor 1.

<Hardenable Resinous Layer>

| | |
|---|---|
| Methyltrimethoxysilane | 180 g |
| Compound (Exemplified Compound (B-8) | 60 g |
| Antioxidant (Exemplified Compound 2-1) | 1 g |
| 2-Propanol | 225 g |
| 3 percent Acetic acid | 30 g |
| Trisacetylacetonataluminum | 3 g |

The compounds above were mixed and stirred at room temperature for 16 hours to prepare a silane compound oligomer liquid medium. Subsequently Exemplified Compound B-12, an antioxidant, and trisacetylacetonataluminum were added to said oligomer and the resulting mixture was stirred for 2 hours, and subsequently filtered to prepare a hardenable resinous layer coating composition. The resulting coating composition was applied onto the aforementioned charge transport layer, employing a circular amount-regulating coating device so as to form a hardenable resinous layer having a dried layer thickness of 2.5 $\mu$m. The resulting coated layer was thermally hardened at 110° C. for one hour to form a siloxane based resinous layer having a cross-linking structure . Thus Photoreceptor 5 was prepared. The ionization potential of the resulting hardenable resinous layer was 4.98 eV. Accordingly, the difference in the ionization potential between the hardenable resinous layer of Photoreceptor 5 and the charge transport layer was 0.42 eV.

Preparation of Developer

Preparation of Developer 1

After melt kneading 100 parts of styrene-acryl resin having a weight ratio of styrene:butyl acrylate:butyl methacrylate=75:20:5, 10 parts of carbon black, and 4 parts of low molecular weight polypropylene (having an average molecular weight of 3,500), the resulting product was pulverized employing a pulverizer, and classified twice employing a pneumatic classifier. Added to the resulting colored particles was 1.2 percent by weight of hydrophobic silica (having a degree of hydrophobicity of 75 and a number average particle diameter of 12 nm). The resulting mixture was mixed for 10 minutes employing a Henschel mixer at a peripheral speed of 40 m/second and a temperature of 50° C. Thus Toner 1 was obtained. The number average particle diameter and the ratio (in percent by number) of the shape coefficient of said toner were 7.3 $\mu$m and between 1.0 and 1.6, respectively.

The resulting toner was mixed with a silicone resin-coated ferrite carrier having a volume average particle diameter of 45 $\mu$m, and thus Developer 1, having a toner concentration of 6 percent, was prepared.

Incidentally, the number average particle diameter of a carrier was determined employing a laser diffraction type particle size distribution measuring apparatus, "Helos" (manufactured by Sympatec Co.).

Preparation of Developer 2

Placed in a vessel were 0.90 g of sodium n-dodecylsulfonate and 10 liters of pure water, resulting in a solution. Gradually added to the resulting solution were 1.2 kg of Regal 330R (a carbon black manufactured by Cabot Co.). Subsequently, the resulting mixture was continuously dispersed for 20 hours employing a sand grinder (medium homogenizer). After performing dispersion, the particle diameter of said dispersion was determined employing electrophoresis light scattering photometer ELS-800, manufactured by Otsuka Denshi Co., whereby the weight average particle diameter of 122 nm was obtained. The resulting dispersion was designated as "Colorant Dispersion 1".

0.055 kg of sodium dodecylbenzenesulfonate was placed in 4 liters of deionized water and dissolved while stirring at room temperature. The resulting solution was designated as Anionic Surface Active Agent Solution A.

0.014 kg of nonylphenol alkyl ether was mixed with 12 liters of deionized water and dissolved at room temperature. The resulting solution was designated as Initiator Solution A.

Placed into a 100-liter reaction vessel fitted with a thermal sensor, a cooling pipe, and a nitrogen gas inlet unit were 3.41 kg of polypropylene emulsion having a number average molecular weight (Mn) of 3,500, and Anionic Surface Active Agent A as well as Nonionic Surface Active Agent A, and the resulting mixture was stirred. Subsequently, 44 liters of deionized water were added.

The resulting mixture was heated and when it reached to 75° C., the total amount of Initiator Solution A was added. Thereafter, while maintaining the temperature of the mixture at 75±1° C., 12.1 kg of styrene, 2.88 kg of n-butyl acrylate, 1.04 kg of methacrylic acid, and 548 g of t-dodecylmercaptan were added.

Subsequently, the resulting mixture was cooled to 80±1° C. and mixed for 6 hours while maintaining said temperature.

The resulting mixture was then cooled to not more than 40° C. and stirring was terminated. Filtration was carried out employing a pole filter. The resulting filtrate was designated as Latex A1.

Incidentally, the resinous particles in said Latex A1 had a glass transition temperature of 57° C., a softening point of 121° C., and the molecular weight distribution of a weight average molecular weight of 12,700, as well as a weight average particle diameter of 120 nm.

200.7 g of potassium persulfate was mixed with 12 liters of deionized water and dissolved while stirring at room temperature. The resulting solution was designated as Initiator Solution B.

Placed into a 100-liter reaction vessel fitted with a thermal sensor, a cooling pipe, a nitrogen gas inlet pipe, and a comb-shaped baffle was Nonionic Surface Active Agent A and stirred. Subsequently, 44 liters of deionized water were added.

The resulting mixture was heated to 70° C., and then Initiator Solution B was added. At the same time, placed was a solution which was previously prepared by mixing 11 kg of styrene, 4 kg of n-butyl acrylate, 1.04 kg of methacrylic acid, and 9.02 g of t-dodecylmercaptan.

Thereafter, the temperature of the mixture was controlled at 72±2° C. and stirring was carried out for 6 hours. Subsequently, the solution was cooled to not more than 40° C. and stirring was terminated. Filtration was carried out employing a pole filter, and the resulting filtrate was designated as Latex B1. Incidentally, the resinous particles in said Latex B1 had a glass transition temperature of 58° C., a softening point of 132° C., and a molecular weight distribution of a weight average molecular weight of 245,000 as well as a weight average particle diameter of 110 nm.

5.36 kg of sodium chloride, employed as a salting-out agent, were placed in 20 liters of deionized water and dissolved. The resulting solution was designated as Sodium Chloride Solution A.

Placed into a 100-liter SUS reaction vessel (having anchor blades as the stirring blades), fitted with a thermal sensor, a cooling pipe, a nitrogen gas inlet device, and a comb-shaped baffle, were 20 kg of Latex A1, 5.2 kg of Latex B1, and 0.4 kg of Colorant Dispersion, prepared as described above, as well as 20 kg of deionized water, and stirred. Subsequently, the resulting mixture was heated to 35° C., and Sodium Chloride Solution A was added. After setting the resulting mixture aside for 5 minutes, it was heated to 85° C. within 5 minutes (the rate of heating being 10° C./minute). The mixture was stirred at 85±2° C. for 6 hours, and then was subjected to salting-out and fusion. Thereafter, the resulting mixture was cooled to not more than 30° C., and stirring was terminated. It was filtered employing a 45 μm sieve. The resulting filtrate was designated Coalesced Composition (1). Subsequently, wet cake-like non-spherical particles were collected from Coalesced Composition (1), employing a centrifugal separator. The resulting particles were then washed with deionized water.

The wet cake-like colored particles, which had been subjected to washing, were dried using 40° C. forced air, and thus colored particles were obtained. The number average particle diameter of said colored particles was 4.6 μm. Further, 1 percent, by weight, of hydrophobic silica (having a degree of hydrophobicity of 65 and a number average primary particle diameter of 12 nm) was added to said colored particles, and the resulting mixture was mixed employing a Henschel mixer at a peripheral speed of 20 m/second and 41° C. for 10 minutes, to obtain Toner 2. The number average particle diameter and the ratio (percent by number) of the shape coefficient between 1.0 and 1.6 were 4.6 μm and 81.1, respectively.

The resulting Toner 2 was mixed with a silicone resin-coated ferrite carrier having a volume average particle diameter of 45 μm in the same manner as Developer 1, and thus Developer 2 having a toner concentration of 6 percent was prepared.

<Evaluation>

1. Evaluation of Response Time ($T_{10}$) of Photoreceptors

The response time of photoreceptors was evaluated employing a photoreceptor test apparatus EPA-8100 (manufactured by Kawaguchi Denki Co.).

A prepared drum was cut into approximately 5×5 cm board, which was mounted on said test apparatus. At a static mode, said apparatus was set so as to have an electrostatic potential of −600±20 V. Further, sufficient exposure amount was set so that the surface electric potential of the photoreceptor reached −200 V or less employing a white light, and the surface electric potential after light irradiation was measured at an interval of 10 milliseconds. As a response rate, obtained was an elapsed time, $T_{10}$, during which the average of 10 surface electric potential differences, measured in the adjacent time interval, reached 10 V or less.

2. Image Evaluation (Examples 1 through 3 and Comparative Examples 1 through 3 were carried out in combinations of photoreceptors and developers shown in Table 1.)

Properties of said photoreceptors were evaluated as follows. Each photoreceptor was mounted on a modified Konica digital copier 7075, manufactured by Konica Corp. (a copier of 75 A4 sheets/minute, comprising laser exposure, reversal development, claw separation, and a blade cleaning process). The linear speed of said photoreceptor was controlled so as to obtain a time of 120 milliseconds between the image exposure process and the development process, and the initial charge potential was set at −750 V. In each environmental condition of low temperature and low humidity, LL (10° C. and 20 percent relative humidity) and high temperature and high humidity, HH (30° C. and 80 percent relative humidity), 30,000 A4 sheets were continually copied and the resulting images were evaluated.

Images were evaluated as follows. An image exposure having a dot density of 400 dpi was carried out while changing the laser beam spot area to 800, 1,900, and 3,200 $\mu m^2$. An original document comprising a text image having a pixel ratio of 7 percent, a portrait, a solid white image, and a solid black image, each having the same area, was copied and the resulting images were visually evaluated.

Process Conditions for Evaluation

Image evaluation conditions, which were employed to operate said Konica digital copier 7075, were set as described hereunder.

Charging Condition

Charging unit: Scorotron charging unit, in which the initial charge potential was set at −750 V.

Developing Conditions

DC bias: −500 V

Dsd (distance between the photoreceptor and the development sleeve): 600 μm

Regulation of developer layer: magnetic H-Cut system

Thickness of developer layer: 700 μm

Diameter of development sleeve: 40 mm

Transfer Condition

Transfer electrodes: corona charging system, transfer dummy electric current value: 45 μA Cleaning Conditions Elastic body rubber blade: free length of 9 mm, thickness of 2 mm, hardness of 70 degrees, impact resilience of 35, photoreceptor contact pressure (in linear pressure) of 15 g/cm Image Properties Evaluation of dot image quality A: dot image is almost faithfully reproduced B: dot image is clearly reproduced though an increase or a decrease in dots results C: dot image is degraded in accordance with an increase in numbers of copied sheets and characters in the text image are not clearly reproduced D: dot image is degraded and characters in the text image are markedly degraded.

TABLE 1

| Example or Comparative Example No. | Photo-receptor No. | Response Time, $T_{10}$ (in second) | Developer No. | Image Evaluation Spot Area (in $\mu m^2$) 3200 HH | 3200 LL | 1900 HH | 1900 LL | 800 HH | 800 LL |
|---|---|---|---|---|---|---|---|---|---|
| Example 1 | 1 | 0.05 | 1 | B | B | B | B | A | A |
| Example 2 | 1 | 0.05 | 2 | B | B | A | A | A | A |
| Example 3 | 2 | 0.16 | 1 | C | B | B | B | B | B |
| Comparative Example 1 | 3 | 0.30 | 1 | C | D | C | D | C | D |

TABLE 1-continued

| Example or Comparative Example No. | Photo-receptor No. | Response Time, $T_{10}$ (in second) | Developer No. | Image Evaluation Spot Area (in $\mu m^2$) 3200 HH | 3200 LL | 1900 HH | 1900 LL | 800 HH | 800 LL |
|---|---|---|---|---|---|---|---|---|---|
| Comparative Example 2 | 4 | 0.20 | 1 | D | D | D | D | C | D |
| Comparative Example 3 | 5 | 0.14 | 1 | D | C | D | D | C | D |

Example 4

Evaluation was carried out in the same manner as Example 1, except that the time of 120 milliseconds between the image exposure process and the development process was changed to 90 milliseconds.

Comparative Example 4

Evaluation was carried out in the same manner as Comparative Example 1, except that the time of 120 milliseconds between the image exposure process and the development process was changed to 90 milliseconds.

TABLE 2

| Example or Comparative Example No. | Photo-receptor No. | Response Time, $T_{10}$ (in second) | Developer No. | Image Evaluation Spot Area (in $\mu m^2$) 3200 HH | 3200 LL | 1900 HH | 1900 LL | 800 HH | 800 LL |
|---|---|---|---|---|---|---|---|---|---|
| Example 4 | 1 | 0.05 | 1 | B | B | B | B | A | A |
| Comparative Example 4 | 1 | 0.20 | 2 | D | D | D | D | D | D |

When the time between the image exposure process and the development process is not more than 100 milliseconds, the effects of the present invention are more markedly exhibited.

Evaluation

As can clearly be seen from Table 1, photoreceptors of Examples 1 through 3, which had a difference in the ionization potential of not more than 0.4 eV between the hardenable resinous layer of the present invention and the charge transport layer, produced excellent dot images, while photoreceptors of Comparative Examples 1 through 3, which had a difference in the ionization potential of at least 0.4 eV, produced degraded dot images. Further, it was found that the image exposure, using a light beam having a spot area of not more than 2,000 $\mu m^2$, produced better image quality. In addition, in the image forming method, in which the time from exposure to development was not more than 100 milliseconds, the effects of the present invention are more markedly exhibited based on the comparison of Example 4 to Comparative Example 4 in Table 2.

The aforementioned examples reveal that the electrophotographic photoreceptor of the present invention, which comprises a photosensitive layer as well as a hardenable resinous layer, forms excellent dot images under severe environmental conditions of low temperature and low humidity, as well as high temperature and high humidity, and further, the image forming method, as well as the image forming apparatus, which utilizes said photoreceptor, exhibits excellent effects.

What is claimed is:

1. An electrophotographic photoreceptor comprises an electrically conductive support having thereon a photosensitive layer and a hardenable resinous layer on the outside thereof, wherein a difference in ionization potential between said photosensitive layer and said hardenable resinous layer is not more than 0.4 eV, and a response time $T_{10}$ defined below is more than 0.25 second, Response Time $T_{10}$ When a photoreceptor charged at |600 V|±20 V is subjected to a sufficient amount of light irradiation so that |200 V| or less results due to light decay, said response time $T_{10}$ refers to the elapsed time during which the average of 10 electrical potentials between surface electric potential data adjacent to each other, which are measured at an interval of 10 milliseconds after light irradiation, reaches 10 V or less.

2. The electrophotographic photoreceptor of claim 1, wherein the photosensitive layer comprises a charge generating layer and a charge transport layer, and a difference in ionization potential between said charge transport layer and said hardenable resinous layer is not more than 0.4 eV, and a response time $T_{10}$ is not more than 0.25 second.

3. The electrophotographic photoreceptor of claim 1, wherein said hardenable resinous layer is a siloxane based resinous layer which is obtained by allowing an organic silicon compound having a hydroxyl group or a hydrolyzable group to react with a compound repesented by General Formula (1), $$B—(R_1—ZH)_m \qquad \text{General Formula (1)}$$

wherein B represents a univalent or multivalent group comprising structural units having charge transportability, $R_1$ represents a single bond or divalent alkylene group, Z represents an oxygen atom, a sulfur atom or NH, and m represents an integer of 1 to 4.

4. The electrophotographic photoreceptor of claim 3, wherein Z in General Formula (1) is an oxygen atom.

5. The electrophotographic photoreceptor of claim 1, wherein said hardenable resinous layer is a cross-linking structure containing siloxane based resinous layer exhibiting charge transportability.

6. The electrophotographic photoreceptor of claim 5, wherein said siloxane based resinous layer comprises the partial structure represented by General Formula (2), $$B—(R_1—ZH)_m \qquad \text{General Formula (2)}$$

wherein B represents a univalent or multivalent group comprising structural units having charge transportability, $R_1$ represents a single bond or divalent alkylene group, Z represents an oxygen atom, a sulfur atom or NH, and m represents an integer of 1 to 4.

7. The electrophotographic photoreceptor of claim 1, wherein said hardenable resinous layer comprises colloidal silica or metal oxide particles.

8. The electrophotographic photoreceptor of claim 1, wherein said hardenable resinous layer comprises an antioxidant.

9. The electrophotographic photoreceptor of claim 1, wherein said hardenable resinous layer is a protective layer of said electrophotographic photoreceptor.

10. The electrophotographic photoreceptor of claim 1, wherein the total layer thickness of said photosensitive layer and said hardenable resinous layer is not more than 15 $\mu$m, and said response time $T_{10}$ is not more than 0.1 second.

11. An image forming method comprising charging, image exposure to form a latent image, developing the latent image by a developer comprising a toner, and blade cleaning to remove residual toner on an electrophotographic photoreceptor, wherein the latent image is formed on the electrophotographic photoreceptor of claim 1, by employing a light beam having a spot area of not more than 2,000 $\mu m^2$ during said image exposure.

12. The image forming method of claim 11, wherein the spot area of said light beam is not more than 1,000 $\mu m^2$.

13. The image forming method of claim 11, wherein the electrophotographic photoreceptor is employed and the average particle diameter of a toner employed in said development process is between 3 and 8 $\mu$m.

14. The image forming method of claim 13, wherein the ratio of toner having a shape coefficient of 1.0 to 1.6, is at least 65 percent in terms of the number of particles of the toner.

15. The image forming method of claim 13, wherein the latent image is formed employing a light beam having a spot area of not more than 2,000 $\mu m^2$.

16. An image forming method comprising charging, image exposure to form a latent image, developing the latent image by a developer comprising a toner, and blade cleaning to remove residual toner on an electrophotographic photoreceptor, wherein the latent image is formed on the electrophotographic photoreceptor of claim 1, and time from said image exposure to said development is within 100 milliseconds.

17. An image forming apparatus which comprising an electrophotographic photoreceptor, a charging device, an image exposure device, a development device, and a blade cleaning device, wherein the electrophotographic photoreceptor is that of claim 1, wherein a latent image is formed on the electrophotographic photoreceptor of claim 1, and by employing a light beam having a spot area of 2,000 $\mu m^2$ in said image exposure means.

18. An image forming apparatus which comprising an electrophotographic photoreceptor, a charging device, an image exposure device, a development device, and a blade cleaning device, wherein the electrophotographic photoreceptor is that of claim 1, wherein the development device comprises a toner having an average particle diameter of 3 to 8 $\mu$m in said development device.

19. An image forming apparatus of claim 18, wherein the ratio of said toner, having a shape coefficient in the range of 1.0 to 1.6, is at least 65 percent in terms of the number of particles of the toner.

20. An image forming apparatus of claim 18, wherein a latent image is formed employing a light beam having a spot area of not more than 2,000 $\mu m^2$ during the image exposure process.

21. An image forming apparatus comprising an electrophotographic photoreceptor, a charging device, an image exposure device, a development device, and a blade cleaning device, wherein the electrophotographic photoreceptor is that of claim 1, wherein the development is conducted at a rate so that time from process by said image exposure device to process by said development device is within 100 milliseconds.

22. A processing cartridge employed in an image forming apparatus comprising a charging device, an image exposure device, a development device and a cleaning device, wherein the process cartridge has an integral combination of the photoreceptor of claim 1, with any one of a charging device, exposure device, a development device, and a cleaning device, and is free to be mounted on and to be dismounted from said image forming apparatus.

* * * * *